US011653166B2

(12) United States Patent
Thagadur Shivappa

(10) Patent No.: US 11,653,166 B2
(45) Date of Patent: May 16, 2023

(54) DIRECTIONAL AUDIO GENERATION WITH MULTIPLE ARRANGEMENTS OF SOUND SOURCES

(71) Applicant: QUALCOMM Incorporated, San Diego, CA (US)

(72) Inventor: Shankar Thagadur Shivappa, San Diego, CA (US)

(73) Assignee: Qualcomm Incorporated, San Diego, CA (US)

( * ) Notice: Subject to any disclaimer, the term of this patent is extended or adjusted under 35 U.S.C. 154(b) by 8 days.

(21) Appl. No.: 17/332,813

(22) Filed: May 27, 2021

(65) Prior Publication Data

US 2022/0386059 A1 Dec. 1, 2022

(51) Int. Cl.
*H04S 7/00* (2006.01)
*H04R 1/22* (2006.01)

(52) U.S. Cl.
CPC ..... *H04S 7/302* (2013.01); *H04R 1/22* (2013.01)

(58) Field of Classification Search
CPC ..... H04S 7/302; H04S 7/303; H04S 7/304; H04R 1/22
See application file for complete search history.

(56) References Cited

U.S. PATENT DOCUMENTS 10,412,529 B1 * 9/2019 Dantrey ..... H04S 7/303
2017/0295446 A1 * 10/2017 Thagadur Shivappa ..... H04S 7/304
2019/0215637 A1 * 7/2019 Lee ..... H04R 5/04
2020/0059749 A1 * 2/2020 Casimiro Ericsson ..... G06F 3/017

FOREIGN PATENT DOCUMENTS

EP 2824663 A2 1/2015
WO 2019012131 A1 1/2019

OTHER PUBLICATIONS

International Search Report and Written Opinion—PCT/US2022/072564—ISA/EPO—dated Oct. 10, 2022.

* cited by examiner

*Primary Examiner* — Jason R Kurr
(74) *Attorney, Agent, or Firm* — Moore IP

(57) ABSTRACT

A device includes a memory configured to store instructions. The device also includes a processor configured to execute the instructions to obtain spatial audio data representing audio from one or more sound sources. The processor is also configured to execute the instructions to generate first directional audio data based on the spatial audio data. The first directional audio data corresponds to a first arrangement of the one or more sound sources relative to an audio output device. The processor is further configured to generate second directional audio data based on the spatial audio data. The second directional audio data corresponds to a second arrangement of the one or more sound sources relative to the audio output device. The second arrangement is distinct from the first arrangement. The processor is also configured to generate an output stream based on the first directional audio data and the second directional audio data.

30 Claims, 15 Drawing Sheets

DIRECTIONAL AUDIO GENERATION WITH MULTIPLE ARRANGEMENTS OF SOUND SOURCES

I. FIELD

The present disclosure is generally related to generating directional audio with multiple arrangements of sound sources.

II. DESCRIPTION OF RELATED ART

Advances in technology have resulted in smaller and more powerful computing devices. For example, there currently exist a variety of portable personal computing devices, including wireless telephones such as mobile and smart phones, tablets and laptop computers that are small, lightweight, and easily carried by users. These devices can communicate voice and data packets over wireless networks. Further, many such devices incorporate additional functionality such as a digital still camera, a digital video camera, a digital recorder, and an audio file player. Also, such devices can process executable instructions, including software applications, such as a web browser application, that can be used to access the Internet. As such, these devices can include significant computing capabilities.

The proliferation of such devices has facilitated changes in media consumption. There has been an increase in interactive audio content such as in personal electronic gaming, where a handheld or portable electronic game system is used to play an electronic game and the audio content is based on user interaction with the game. Such personalized or individualized media consumption often involves relatively small, portable (e.g., battery-powered) devices for generating output. The processing resources available to such portable devices may be limited due to the size of the portable device, weight constraints, power constraints, or for other reasons. In some cases, waiting for the user interaction to initiate rendering of the interactive audio content can cause delay in the audio output. As a result, it can be challenging to provide a high quality user experience.

III. SUMMARY

According to one implementation of the present disclosure, a device includes a memory and a processor. The memory is configured to store instructions. The processor is configured to execute the instructions to obtain spatial audio data representing audio from one or more sound sources. The processor is also configured to execute the instructions to generate first directional audio data based on the spatial audio data. The first directional audio data corresponds to a first arrangement of the one or more sound sources relative to an audio output device. The processor is further configured to execute the instructions to generate second directional audio data based on the spatial audio data. The second directional audio data corresponds to a second arrangement of the one or more sound sources relative to the audio output device. The second arrangement is distinct from the first arrangement. The processor is also configured to execute the instructions to generate an output stream based on the first directional audio data and the second directional audio data.

According to another implementation of the present disclosure, a device includes a memory and a processor. The memory is configured to store instructions. The processor is configured to execute the instructions to receive, from a host device, first directional audio data representing audio from one or more sound sources. The first directional audio data corresponds to a first arrangement of the one or more sound sources relative to an audio output device. The processor is also configured to execute the instructions to receive, from the host device, second directional audio data representing the audio from the one or more sound sources. The second directional audio data corresponds to a second arrangement of the one or more sound sources relative to the audio output device. The second arrangement is distinct from the first arrangement. The processor is further configured to receive position data indicating a position of the audio output device. The processor is also configured to generate an output stream based on the first directional audio data, the second directional audio data, and the position data. The processor is further configured to provide the output stream to the audio output device.

According to another implementation of the present disclosure, a method includes obtaining, at a device, spatial audio data representing audio from one or more sound sources. The method also includes generating, at the device, first directional audio data based on the spatial audio data. The first directional audio data corresponds to a first arrangement of the one or more sound sources relative to an audio output device. The method further includes generating, at the device, second directional audio data based on the spatial audio data. The second directional audio data corresponds to a second arrangement of the one or more sound sources relative to the audio output device. The second arrangement is distinct from the first arrangement. The method also includes generating, at the device, an output stream based on the first directional audio data and the second directional audio data. The method further includes providing the output stream from the device to the audio output device.

According to another implementation of the present disclosure, a method includes receiving, at a device from a host device, first directional audio data representing audio from one or more sound sources. The first directional audio data corresponds to a first arrangement of the one or more sound sources relative to an audio output device. The method also includes receiving, at the device from the host device, second directional audio data representing the audio from the one or more sound sources. The second directional audio data corresponds to a second arrangement of the one or more sound sources relative to the audio output device. The second arrangement is distinct from the first arrangement. The method further includes receiving, at the device, position data indicating a position of the audio output device. The method also includes generating, at the device, an output stream based on the first directional audio data, the second directional audio data, and the position data. The method further includes providing the output stream from the device to the audio output device.

According to another implementation of the present disclosure, a non-transitory computer-readable medium includes instructions that, when executed by one or more processors, cause the one or more processors to obtain spatial audio data representing audio from one or more sound sources. The instructions, when executed by the one or more processors, also cause the one or more processors to generate first directional audio data based on the spatial audio data. The first directional audio data corresponds to a first arrangement of the one or more sound sources relative to an audio output device. The instructions, when executed by the one or more processors, further cause the one or more processors to generate second directional audio data based on the spatial audio data. The second directional audio data corresponds to a second arrangement of the one or more sound sources relative to the audio output device. The second arrangement is distinct from the first arrangement. The instructions, when executed by the one or more processors, also cause the one or more processors to generate an output stream based on the first directional audio data and the second directional audio data. The instructions, when executed by the one or more processors, also cause the one or more processors to provide the output stream to the audio output device.

According to another implementation of the present disclosure, a non-transitory computer-readable medium includes instructions that, when executed by one or more processors, cause the one or more processors to receive, from a host device, first directional audio data representing audio from one or more sound sources. The first directional audio data corresponds to a first arrangement of the one or more sound sources relative to an audio output device. The instructions, when executed by the one or more processors, also cause the one or more processors to receive, from the host device, second directional audio data representing the audio from the one or more sound sources. The second directional audio data corresponds to a second arrangement of the one or more sound sources relative to the audio output device. The second arrangement is distinct from the first arrangement. The instructions, when executed by the one or more processors, further cause the one or more processors to receive position data indicating a position of the audio output device. The instructions, when executed by the one or more processors, also cause the one or more processors to generate an output stream based on the first directional audio data, the second directional audio data, and the position data. The instructions, when executed by the one or more processors, further cause the one or more processors to provide the output stream to the audio output device.

According to another implementation of the present disclosure, an apparatus includes means for obtaining spatial audio data representing audio from one or more sound sources. The apparatus also includes means for generating first directional audio data based on the spatial audio data. The first directional audio data corresponds to a first arrangement of the one or more sound sources relative to an audio output device. The apparatus further includes means for generating second directional audio data based on the spatial audio data. The second directional audio data corresponds to a second arrangement of the one or more sound sources relative to the audio output device. The second arrangement is distinct from the first arrangement. The apparatus also includes means for generating an output stream based on the first directional audio data and the second directional audio data. The apparatus further includes means for providing the output stream to the audio output device.

According to another implementation of the present disclosure, an apparatus includes means for receiving, from a host device, first directional audio data representing audio from one or more sound sources. The first directional audio data corresponds to a first arrangement of the one or more sound sources relative to an audio output device. The apparatus also includes means for receiving, from the host device, second directional audio data representing the audio from the one or more sound sources. The second directional audio data corresponds to a second arrangement of the one or more sound sources relative to the audio output device. The second arrangement is distinct from the first arrangement. The apparatus further includes means for receiving position data indicating a position of the audio output device. The apparatus also includes means for generating an output stream based on the first directional audio data, the second directional audio data, and the position data. The apparatus further includes means for providing the output stream to the audio output device.

Other aspects, advantages, and features of the present disclosure will become apparent after review of the entire application, including the following sections: Brief Description of the Drawings, Detailed Description, and the Claims.

IV. BRIEF DESCRIPTION OF THE DRAWINGS

V. DETAILED DESCRIPTION

Figure 1:
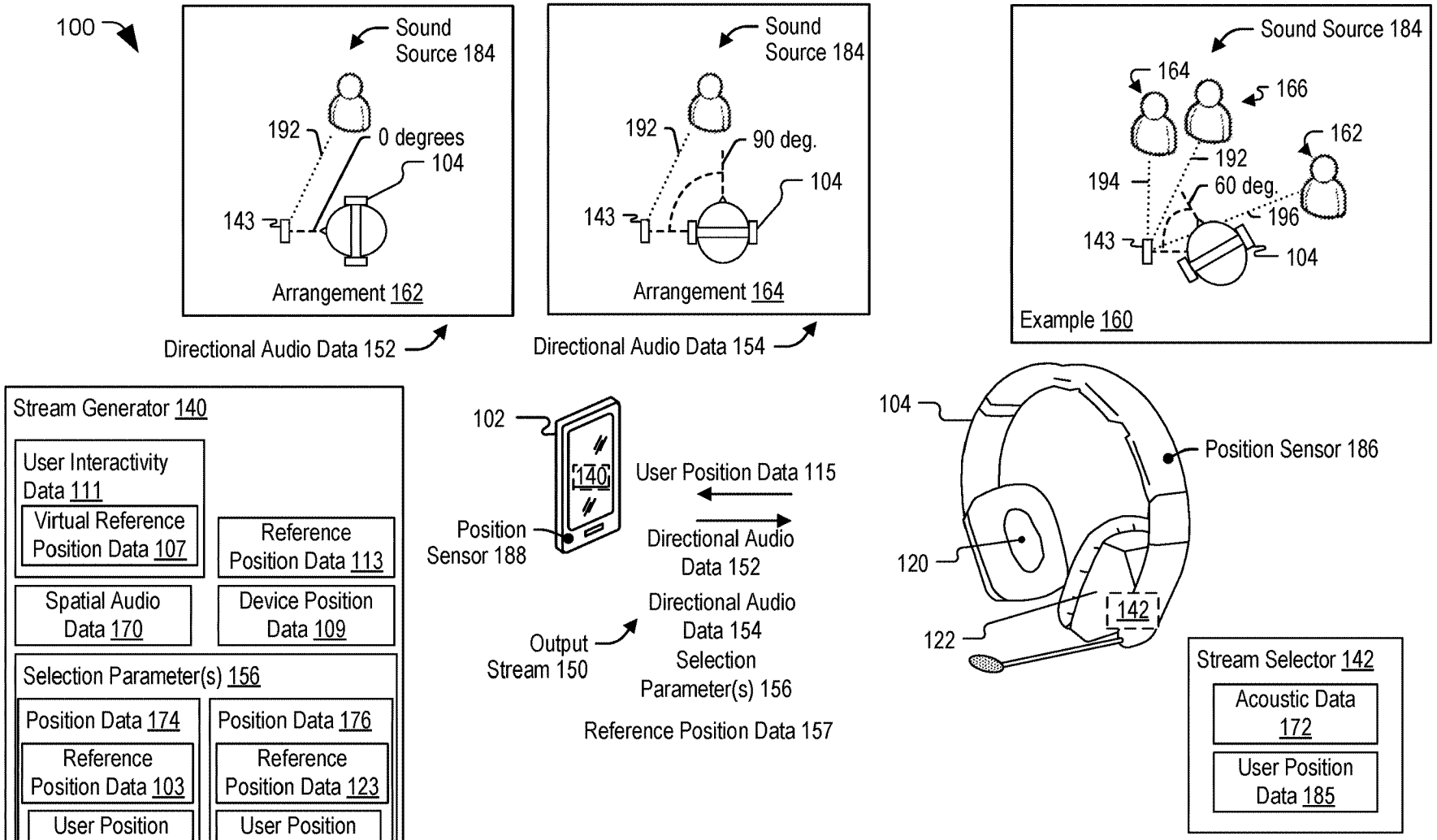
FIG. 1 is a block diagram of a particular illustrative aspect of a system operable to generate directional audio with multiple sound source arrangements, in accordance with some examples of the present disclosure.

Audio information can be captured or generated in a manner that enables rendering of audio output to represent a three-dimensional (3D) sound field. For example, ambisonics (e.g., first-order ambisonics (FOA) or higher-order ambisonics (HOA)) can be used to represent a 3D sound field for later playback. During playback, the 3D sound field can be reconstructed in a manner that enables a listener to distinguish the position and/or distance between the listener and one or more sound sources of the 3D sound field.

According to a particular aspect of the disclosure, a 3D sound field can be rendered using a personal audio device, such as a headset, headphones, ear buds, or another audio playback device that is configured to generate directional audio output for a binaural user experience. One challenge of rendering 3D audio using a personal audio device is the computational complexity of such rendering. To illustrate, a personal audio device is often configured to be worn by the user, such that motion of the user's head changes the relative positions of the user's ears and the sound source(s) in the 3D sound field to generate head-tracked immersive audio. Such personal audio devices are often battery powered and have limited on-board computing resources. Generating head-tracked immersive audio with such resource constraints is challenging. Another challenge associated with rendering interactive audio content is that waiting for user interactions to initiate rendering of corresponding audio content can increase audio delay.

Some aspects disclosed herein facilitate sidestepping of certain power- and processing-constraints of personal audio devices by performing much of the processing at a host device, such as a laptop computer or a mobile computing device. Additionally, multiple sets of directional audio data are generated with each set of directional audio data corresponding to a user position of the user, a reference position of a reference point, or both. In a particular example, the reference point includes the host device, a virtual reference point, a display screen, or a combination thereof. Some aspects disclosed herein facilitate audio output delay reduction by generating the sets of directional audio data based on predicted user interactions. The sets of directional audio data are provided to the personal audio device and the personal audio device selects the directional audio data corresponding to detected position data for output. In some examples, the host device generates multiple sets of directional audio data in advance (e.g., based on predicted position data) and provides a selected set of directional audio data to the personal audio device corresponding to detected position data to further offload processing from the personal audio device. In some examples, a single audio device (e.g., having certain power and processing capabilities) generates the sets of directional audio data in advance (e.g., based on predicted position data), selects a set of directional audio data corresponding to detected position data, and outputs the selected directional audio data to reduce audio delay associated with rendering interactive audio content.

Particular aspects of the present disclosure are described below with reference to the drawings. In the description, common features are designated by common reference numbers. As used herein, various terminology is used for the purpose of describing particular implementations only and is not intended to be limiting of implementations. For example, the singular forms "a," "an," and "the" are intended to include the plural forms as well, unless the context clearly indicates otherwise. Further, some features described herein are singular in some implementations and plural in other implementations. To illustrate, FIG. 1 depicts a stream generator 140 including one or more selection parameters ("selection parameter(s)" 156 of FIG. 1), which indicates that in some implementations the stream generator 140 generates a single selection parameter 156 and in other implementations the stream generator 140 generates multiple selection parameters 156.

As used herein, the terms "comprise," "comprises," and "comprising" may be used interchangeably with "include," "includes," or "including." Additionally, the term "wherein" may be used interchangeably with "where." As used herein, "exemplary" indicates an example, an implementation, and/or an aspect, and should not be construed as limiting or as indicating a preference or a preferred implementation. As used herein, an ordinal term (e.g., "first," "second," "third," etc.) used to modify an element, such as a structure, a component, an operation, etc., does not by itself indicate any priority or order of the element with respect to another element, but rather merely distinguishes the element from another element having a same name (but for use of the ordinal term). As used herein, the term "set" refers to one or more of a particular element, and the term "plurality" refers to multiple (e.g., two or more) of a particular element.

As used herein, "coupled" may include "communicatively coupled," "electrically coupled," or "physically coupled," and may also (or alternatively) include any combinations thereof. Two devices (or components) may be coupled (e.g., communicatively coupled, electrically coupled, or physically coupled) directly or indirectly via one or more other devices, components, wires, buses, networks (e.g., a wired network, a wireless network, or a combination thereof), etc. Two devices (or components) that are electrically coupled may be included in the same device or in different devices and may be connected via electronics, one or more connectors, or inductive coupling, as illustrative, non-limiting examples. In some implementations, two devices (or components) that are communicatively coupled, such as in electrical communication, may send and receive signals (e.g., digital signals or analog signals) directly or indirectly, via one or more wires, buses, networks, etc. As used herein, "directly coupled" may include two devices that are coupled (e.g., communicatively coupled, electrically coupled, or physically coupled) without intervening components.

In the present disclosure, terms such as "determining," "calculating," "estimating," "shifting," "adjusting," etc. may be used to describe how one or more operations are performed. It should be noted that such terms are not to be construed as limiting and other techniques may be utilized to perform similar operations. Additionally, as referred to herein, "generating," "calculating," "estimating," "using," "selecting," "accessing," and "determining" may be used interchangeably. For example, "generating," "calculating,"

"estimating," or "determining" a parameter (or a signal) may refer to actively generating, estimating, calculating, or determining the parameter (or the signal) or may refer to using, selecting, or accessing the parameter (or signal) that is already generated, such as by another component or device.

Referring to FIG. 1, a particular illustrative aspect of a system configured to generate directional audio with multiple sound source arrangements is disclosed and generally designated 100. The system 100 includes a device 102 (e.g., a host device) that is configured to communicate with a device 104 (e.g., an audio output device).

The spatial audio data 170 represents sound from one or more sound sources 184 (which may include real or virtual sources) in three-dimensions (3D) such that audio output representing the spatial audio data 170 can simulate distance and direction between a listener and the one or more sound sources 184. The spatial audio data 170 can be encoded using various encoding schemes, such as first order ambisonics (FOA), higher order ambisonics (HOA), or an equivalent spatial domain (ESD) representation (as described further below). As an example, FOA coefficients or ESD data representing the spatial audio data 170 can be encoded using four total channels, such as two stereo channels.

The device 102 is configured to process spatial audio data 170 to generate sets of directional audio data corresponding to multiple sound source arrangements using a stream generator 140, as further described with reference to FIG. 2A. In a particular aspect, the stream generator 140 is configured to obtain user interactivity data 111, the spatial audio data 170, or both, from an application of the device 102, such as a video player, a video game, an online meeting, etc. In a particular aspect, the user interactivity data 111 indicates positions of virtual objects in a virtual space, a mixed reality space, or an augmented reality space.

In a particular aspect, the spatial audio data 170 represents sound from a sound source 184 that is to be perceived to be coming from a position 192 (e.g., to the left and from a particular distance) relative to a reference point 143 (e.g., the device 102, a display screen, another physical reference point, a virtual reference point, or a combination thereof) when the spatial audio data 170 is played out. In a particular aspect, the reference point 143 can have a fixed location (e.g., a driver seat) in a frame of reference (e.g., a vehicle). For example, the sound from the sound source 184 is to be perceived to be coming from a driver seat of a vehicle whether the user wearing the device 104 is looking out a side window or looking straight ahead. In another aspect, the reference point 143 (e.g., a non-player character (NPC)) can move within a frame of reference (e.g., a virtual world). For example, the sound from the sound source 184 is to be perceived to be coming from a NPC that a user is following in a virtual world whether the user wearing the device 104 is looking towards the NPC or turns their head to look in other directions.

In a particular aspect, a position sensor 186 is configured to generate user position data 115 indicating a position of a user of the device 104. In a particular aspect, a position sensor 188 is configured to generate device position data 109 indicating a position of the reference point 143 (e.g., the device 102, a display screen of the device 102, another physical reference point, or a combination thereof). In a particular aspect, the user interactivity data 111 includes virtual reference position data 107 indicating a position of the reference point 143 (e.g., a virtual reference point, such as a virtual building in a game) at a first virtual reference position time.

In a particular implementation, the position sensor 188 is external to the device 102. For example, the position sensor 188 includes a camera that is configured to capture an image (e.g., the device position data 109) indicating a position of the device 102. In a particular implementation, the position sensor 188 is integrated in the device 102. For example, the position sensor 188 includes an accelerometer configured to generate sensor data (e.g., the device position data 109) indicating a position of the device 102. In a particular aspect, the position sensor 188 is configured to the generate the device position data 109 indicating a relative position (e.g., a rotation, a displacement, or both), an absolute position (e.g., an orientation, a location, or both), or a combination thereof, of the device 102.

In a particular implementation, the position sensor 186 is external to the device 104. For example, the position sensor 186 includes a camera that is configured to capture an image (e.g., the user position data 115) indicating a position of the user, the device 104, or both. In a particular implementation, the position sensor 186 is integrated in the device 104. For example, the position sensor 186 includes an accelerometer configured to generate sensor data (e.g., the user position data 115) indicating a position of the device 104, the user, or both. In a particular aspect, the position sensor 186 is configured to generate the user position data 115 indicating a relative position (e.g., a rotation, a displacement, or both), an absolute position (e.g., an orientation, a location, or both), or a combination thereof, of the device 104.

In a particular aspect, the stream generator 140 is configured to determine reference position data 113 based on the device position data 109, the virtual reference position data 107, or both. The reference position data 113 indicates a position of the reference point 143. For example, the reference position data 113 is based on the device position data 109 that indicates a position of a physical reference point, the virtual reference position data 107 that indicates a position of a virtual reference point, or both.

In a particular implementation, the stream generator 140 is configured to generate one or more of the sets of directional audio data based at least in part on the reference position data 113, the user position data 115, or both, as further described with reference to FIG. 2A. In a particular implementation, the stream selector 142 is configured to select one of the sets of directional audio data based at least in part on reference position data 157 received from the device 102, user position data 185 received from the position sensor 186, or both, as further described with reference to FIG. 4.

The device 104 includes a speaker 120, a speaker 122, or both. The stream generator 140 is configured to provide the sets of directional audio data to the device 104. The device 104 is configured to select a set of directional audio data from the sets of directional audio data using a stream selector 142, to generate acoustic data 172 based on the set of directional audio data, and to output the acoustic data 172 via the speaker 120, the speaker 122, or both, as further described with reference to FIG. 4.

In some implementations, the device 102, the device 104, or both, correspond to or are included in various types of devices. In a particular aspect, the device 102 includes at least one of a mobile device, a game console, a communication device, a computer, a display device, a vehicle, a camera, or a combination thereof. In a particular aspect, the device 104 includes at least one of a headset, an extended reality (XR) headset, a gaming device, an earphone, a speaker, or a combination thereof. In an illustrative example, the stream generator 140, the stream selector 142, or both, are integrated in a headset device that includes the speaker 120 and the speaker 122, such as described with reference to FIGS. 1 and 6. In some examples, the stream generator 140, the stream selector 142, or both are integrated in at least one of a mobile phone or a tablet computer device, as described with reference to FIGS. 1, 5, and 6, a wearable electronic device, as described with reference to FIG. 9, a voice-controlled speaker system, as described with reference to FIG. 10, or a virtual reality headset or an augmented reality headset, as described with reference to FIG. 11. In another illustrative example, the stream generator 140, the stream selector 142, or both are integrated into a vehicle that also includes the speaker 120 and the speaker 122, such as described further with reference to FIG. 12 and FIG. 13.

During operation, the stream generator 140 obtains the spatial audio data 170 that represents audio from one or more sound sources 184. In a particular aspect, the stream generator 140 retrieves the spatial audio data 170, the user interactivity data 111, or a combination thereof, from a memory. In another aspect, the stream generator 140 receives the spatial audio data 170, the user interactivity data 111, or a combination thereof, from an audio data source (e.g., a server). In a particular example, a user of the device 104 (e.g., a headset) initiates the application (e.g., a game, a video player, an online meeting, or a music player) of the device 102 and the application outputs the spatial audio data 170, the user interactivity data 111, or a combination thereof. In a particular aspect, the stream generator 140 obtains the user interactivity data 111 concurrently with obtaining the spatial audio data 170.

The stream generator 140 processes the spatial audio data 170 based on one or more selection parameters 156 to generate multiple sets of directional audio data. For example, the stream generator 140 processes the spatial audio data 170 based on position data 174 (e.g., default position data, detected position data, or both) to generate directional audio data 152, as further described with reference to FIG. 2A. In a particular example, the position data 174 includes default position data indicating a default position of the device 104, a default head position of the user of the device 104, a default position of the reference point 143, a default relative position of the device 102 and the reference point 143, a default relative movement of the device 102 and the reference point 143, or a combination thereof. In a particular aspect, the default relative position of the reference point 143 and the device 104 corresponds to the user of the device 104 facing the reference point 143.

In a particular aspect, the position data 174 includes detected position data indicating a detected position of the device 104, a detected movement of the device 104, a detected head position of the user of the device 104, a detected head movement of the user of the device 104, a detected position of the reference point 143, a detected movement of the reference point 143, a detected relative position of the device 104 and the reference point 143, a detected relative movement of the device 104 and the reference point 143, or a combination thereof. To illustrate, the position data 174 includes reference position data 103 indicating a first position (e.g., a location, an orientation, or both) of the reference point 143, user position data 105 indicating a first position (e.g., a location, an orientation, or both) of the user of the device 104, or both.

In a particular example, the device 102 receives the user position data 115 indicating a first position, a first movement, or both, detected at a first user position time by the position sensor 186. The stream generator 140 generates (e.g., updates) the user position data 105 based on the user position data 115. For example, the user position data 105 indicates a first absolute position of the user of the device 104, the user position data 115 indicates a change in position of the user of the device 104, and the stream generator 140 updates the user position data 105 to indicate a second absolute position of the user of the device 104 by applying the change in position to the first absolute position.

In a particular example, the stream generator 140 receives the device position data 109 indicating a first position, a first movement, or both, of the reference point 143 (e.g., the device 102, the display screen, or another physical reference point) detected at a first device position time by the position sensor 188. In a particular example, the stream generator 140 receives the virtual reference position data 107 indicating a first position, a first movement, or both, of the reference point 143 (e.g., a virtual reference point) detected (e.g., occurred) at a first virtual reference position time. The stream generator 140 determines the reference position data 113 based on the device position data 109, the virtual reference position data 107, or both. The stream generator 140 generates (e.g., updates) the reference position data 103 based on the reference position data 113. For example, the reference position data 103 indicates a first absolute position of the reference point 143, the reference position data 113 indicates a change in position of the reference point 143, and the stream generator 140 updates the reference point 143 to indicate a second absolute position of the reference point 143 by applying the change in position to the first absolute position.

The directional audio data 152 corresponds to an arrangement 162 of the one or more sound sources 184 relative to a listener (e.g., the device 104). In a particular aspect, the spatial audio data 170 represents sound from a sound source 184 that is to be perceived to be coming from the position 192 relative to the reference point 143 when the spatial audio data 170 is played out. As an illustrative example, the user position data 105 and the reference position data 103 indicate a first position (e.g., 0 degrees (deg.)) of the user wearing the device 104 relative to the reference point 143. In a particular aspect, the user has the first position relative to the reference point 143 by default. In another aspect, the user is detected (e.g., as indicated by the user position data 115) to have the first position relative to the reference point 143.

The stream generator 140 generates the directional audio data 152 to have the arrangement 162 such that the sound from the sound source 184 is perceived to be coming from a second direction (e.g., right) of the listener (e.g., the device 104) when the directional audio data 152 is played out so that the sound would be perceived to be coming from the position 192 relative to the reference point 143 when the user has the user position indicated by the user position data 105 and the reference point 143 has the reference position indicated by the reference position data 103.

In a particular aspect, the stream generator 140 processes the spatial audio data 170 based on one or more sets of position data (e.g., predetermined position data, predicted position data, or both) to generate one or more sets of directional audio data, as further described with reference to FIG. 2A. For example, the stream generator 140 processes the spatial audio data 170 based on position data 176 to generate directional audio data 154.

In a particular aspect, the position data 176 includes reference position data 123 indicating a second position (e.g., a location, an orientation, or both) of the reference position data 123, user position data 125 indicating a second position (e.g., a location, an orientation, or both) of the user of the device 104, or both.

In a particular example, the position data 176 includes predetermined position data indicating a predetermined position of the device 104, a predetermined head position of the user of the device 104, a predetermined position of the reference point 143, a predetermined relative position of the device 102 and the reference point 143, a predetermined relative movement of the device 102 and the reference point 143, or a combination thereof. In a particular aspect, the predetermined relative position of the reference point 143 and the device 104 corresponds to the user of the device 104 facing the reference point 143.

In a particular aspect, the position data 176 includes predicted position data indicating a predicted position of the device 104, a predicted movement of the device 104, a predicted head position of the user of the device 104, a predicted head movement of the user of the device 104, a predicted position of the reference point 143, a predicted movement of the reference point 143, a predicted relative position of the device 104 and the reference point 143, a predicted relative movement of the device 104 and the reference point 143, or a combination thereof. To illustrate, the position data 176 includes reference position data 103 indicating a first position (e.g., a location, an orientation, or both) of the reference point 143, user position data 105 indicating a first position (e.g., a location, an orientation, or both) of the user of the device 104, or both.

In a particular aspect, the reference position data 123, the user position data 125, or both, correspond to a predetermined position of the user of the device 104 relative to the reference point 143. For example, the predetermined position (e.g., 90 degrees) corresponds to the user of the device 104 turned in a particular direction relative to the reference point 143.

In a particular aspect, the stream generator 140 generates sets of directional audio data based on a range of predetermined positions (e.g., 0 degrees, 45 degrees, 90 degrees, 135 degrees, and 180 degrees) of the user of the device 104 relative to the reference point 143. In a particular aspect, the range of predetermined positions is based on the user position detected at a first user position time (e.g., as indicated by the user position data 115), the reference position detected at a first reference position time (e.g., as indicated by the reference position data 113), or both. For example, the stream generator 140, in response to determining that the reference position data 113 and the user position data 115 indicate a relative position (e.g., 90 degrees) of the device 104 to the reference point 143, determines the range of predetermined positions based on (e.g., starting from, ending at, around, or centered on) the relative position (e.g., from 80 degrees to 100 degrees). The stream generator 140 determines first directional audio data corresponding to a first predetermined position (e.g., 80 degrees), the directional audio data 154 corresponding to a second predetermined position (e.g., 90 degrees), third directional audio data corresponding to a third predetermined position (e.g., 100 degrees), or a combination thereof.

In a particular aspect, the reference position data 123 corresponds to a predicted reference position of the reference point 143, the user position data 125 corresponds to a predicted user position of the user of the device 104, or both. In a particular example, the stream generator 140 determines the predicted reference position based on the reference position data 113 (e.g., a detected position, a detected movement, or both), predicted device position data, predicted user interactivity data, or a combination thereof, as further described with reference to FIG. 3. In a particular example, the stream generator 140 determines the predicted user position data based on the user position data 115 (e.g., a detected position, a detected movement, or both), the user interactivity data 111 (e.g., detected user interactivity data), predicted user interactivity data, or a combination thereof, as further described with reference to FIG. 3.

In a particular aspect, the stream generator 140 generates sets of directional audio data based on multiple predicted positions of the user of the device 104 relative to the reference point 143. In a particular aspect, each of the predicted positions is based on the reference position data 113 (e.g., the detected position, the detected movement, or both), predicted device position data, predicted user interactivity data, or a combination thereof. For example, the stream generator 140, in response to determining that a first predicted position of the user of the device 104 relative to the reference point 143 has a first prediction probability that is greater than a threshold probability, determines first directional audio data corresponding to the first predicted position. As another example, the stream generator 140, in response to determining that a second predicted position of the user of the device 104 relative to the reference point 143 has a second prediction probability that is greater than the threshold probability, determines second directional audio data corresponding to the second predicted position.

The directional audio data 154 corresponds to an arrangement 164 of the one or more sound sources 184 relative to a listener (e.g., the device 104). In a particular aspect, the arrangement 164 is distinct from the arrangement 162. As an illustrative example, the user position data 125 and the reference position data 123 indicate a second position (e.g., 90 degrees) of the user of the device 104 relative to the reference point 143. In an illustrative example, the user is facing (e.g., as predetermined or predicted) the position 192. The stream generator 140 generates the directional audio data 154 to have the arrangement 164 such that the sound from the sound source 184 is perceived to be coming from a particular direction (e.g., front) of the listener (e.g., the device 104) when the directional audio data 154 is played out so that the sound would be perceived to be coming from the position 192 relative to the reference point 143 when the user has the user position indicated by the user position data 125 and the reference point 143 has the reference position indicated by the reference position data 123.

In a particular implementation, the stream generator 140 is configured to initiate transmission of an output stream 150 including the sets of directional audio data (e.g., the directional audio data 152, the directional audio data 154, one or more additional sets of directional audio data, or a combination thereof) to the device 104. In a particular aspect, the stream generator 140 also initiates transmission of one or more selection parameters 156 to the device 104 concurrently with the transmission of the output stream 150 to the device 104. The one or more selection parameters 156 indicate the user position, the reference position, or both, associated with a particular set of directional audio data. For example, the one or more selection parameters 156 indicate that the directional audio data 152 is based on the reference position data 103, the user position data 105, or both, of the position data 174. As another example, the one or more selection parameters 156 indicate that the directional audio data 154 is based on the reference position data 123, the user position data 125, or both, of the position data 176. In a particular example, the one or more selection parameters 156 indicate that an additional set of directional audio data is based on particular position data (e.g., corresponding to a predetermined position or a predicted position).

The stream selector 142 receives the output stream 150 and the one or more selection parameters 156 from the device 102. The stream selector 142 renders (e.g., generates) acoustic data 172 based on the output stream 150, reference position data 157, user position data 185, or both. In a particular aspect, the position sensor 188 generates second device position data indicating a device position of the reference point 143 (e.g., the device 102, a display screen, or another physical reference point) detected at a second device position time. In a particular aspect, the second device position time is subsequent to the first device position time associated with the device position data 109. In a particular aspect, the user interactivity data 111 includes second virtual reference position data indicating a reference position of the reference point 143 (e.g., a virtual reference point) detected at a second virtual reference position time. In a particular aspect, the second virtual reference position time is subsequent to the first virtual reference position time associated with the virtual reference position data 107. The stream selector 142 determines the reference position data 157 based on the second device position data, the second virtual position data, or both.

In a particular implementation, the device 102 transmits the reference position data 157 to the device 104 concurrently with transmitting the output stream 150 to the device 104. In an alternate implementation, the second device position time, the second virtual reference position time, or both, are subsequent to a transmission time of the output stream 150 from the device 102 to the device 104. In this implementation, the device 102 transmits the reference position data 157 to the device 104 subsequent to transmitting the output stream 150 to the device 104.

The user position data 185 indicates a position of a user of the device 104. For example, the position sensor 186 generates the user position data 185 indicating a position of the user of the device 104 detected at a second user position time. In a particular aspect, the second user position time is subsequent to the first user position time associated with the user position data 115. In an example 160, the user position data 185 and the reference position data 157 indicate that the user of the device 104 has a detected position (e.g., 60 degrees) relative to the reference point 143.

In a particular aspect, the arrangement 162 corresponds to a first position of the sound source 184 relative to (e.g., from the right of) a listener (e.g., the device 104). When the device 104 has the detected position (e.g., 60 degrees) relative to the reference point 143, the arrangement 162 corresponds to a position 196 of the sound source 184 relative to the reference point 143. In a particular aspect, the arrangement 164 corresponds to a second position of the sound source 184 relative to (e.g., from the front of) a listener (e.g., the device 104). When the device 104 has the detected position (e.g., 60 degrees) relative to the reference point 143, the arrangement 164 corresponds to a position 194 of the sound source 184 relative to the reference point 143.

In a particular implementation, the stream selector 142 selects one of the directional audio data 152, the directional audio data 154, the one or more additional sets of directional audio data, or a combination thereof, based on the detected position (e.g., 60 degrees) of the device 104 relative to the reference point 143, as further described with reference to FIG. 4. The spatial audio data 170 represents sound from the sound source 184 that is to be perceived to be coming from the position 192 relative to the reference point 143 when the spatial audio data 170 is played out. The stream selector 142 selects the directional audio data 154 in response to determining that the position 194 is a closer match of the position 192 than the position 196 is of the position 192. For example, the stream selector 142 selects the directional audio data 154 in response to determining that a difference between the position 194 (corresponding to the arrangement 164) and the position 192 is less than or equal to a difference between the position 196 (corresponding to the arrangement 162) and the position 192. The stream selector 142 decodes the directional audio data 154 (e.g., the selected set of directional audio data) to generate the acoustic data 172.

In a particular implementation, the stream selector 142 generates the acoustic data 172 (e.g., an output stream) by combining the directional audio data 152 and the directional audio data 154 based on the detected position of the device 104 relative to the reference point 143, as further described with reference to FIG. 4. In a particular aspect, the stream generator 140 generates the acoustic data 172 to have an arrangement 166 such that the sound from the sound source 184 is perceived to be coming from a particular direction (e.g., partially right) of the listener (e.g., the device 104) when the acoustic data 172 is played out so that the sound would be perceived as coming from a particular position (e.g., the position 192) of the sound source 184 relative to the reference point 143 when the user has the user position indicated by the user position data 185 and the reference point 143 has the reference position indicated by the reference position data 157. The particular position (e.g., the position 192) is between the position 194 and the position 196. For example, the particular position is closer to the position 196 when greater weight is applied to the directional audio data 152 to generate the acoustic data 172. As another example, the particular position is closer to the position 194 when greater weight is applied to the directional audio data 154 to generate the acoustic data 172.

In a particular aspect, the stream selector 142 outputs the acoustic data 172 via the speaker 120 (e.g., an audio output device). For example, the stream selector 142, in response to determining that the acoustic data 172 corresponds to a particular channel (e.g., a right channel), outputs the acoustic data 172 via the speaker 120 (e.g., a right speaker) corresponding to the particular channel.

The system 100 thus enables generating the acoustic data 172 such that an acoustic arrangement of one or more sound sources 184 relative to a listener (e.g., a user of the device 104) is updated as the position (e.g., an orientation, a location, or both) of the listener changes relative to the reference point 143. Much of the processing to generate the acoustic data 172, such as generating the sets of directional audio data, is performed at the device 102 to conserve resources (e.g., power and computing cycles) at the device 104. In a particular example, generating at least some of the sets of directional audio data in advance based on predicted position data and selecting one of the sets of directional audio data based on detected position data to generate the acoustic data 172 reduces latency between detecting the position data and outputting the acoustic data 172 based on the corresponding directional audio data.

Although the device 104 is illustrated as including the speaker 120 and the speaker 122, in other implementations fewer than two or more than two speakers are integrated in or coupled to the device 104. Although the stream generator 140 and the stream selector 142 are illustrated as included in separate devices, in other implementations the stream generator 140 and the stream selector 142 may be included in a single device, as further described with reference to FIGS. 5-6.

In a particular implementation, the stream generator 140 is configured to generate multiple sets of directional audio data corresponding to various bitrates. For example, the stream generator 140 generates a first copy of the directional audio data 152 corresponding to a first bitrate (e.g., higher bitrate), a second copy of the directional audio data 152 corresponding to a second bitrate (e.g., a lower bitrate), a first copy of the directional audio data 154 corresponding to the first bitrate, a second copy of the directional audio data 154 corresponding to the second bitrate, or a combination thereof.

The stream generator 140 selects a bit rate (e.g., the first bitrate, the second bitrate, or both) based on detecting capabilities, conditions, or both, of a communication link with the stream selector 142. For example, the stream generator 140 selects the first bitrate in response to determining that a first bandwidth of the communication link is greater than a threshold bandwidth. As another example, the stream generator 140 selects the second bitrate in response to determining that the first bandwidth of the communication link is less than or equal to the threshold bandwidth.

The stream generator 140 provides the directional audio data associated with the selected bitrate as the output stream 150 to the stream selector 142. For example, the stream generator 140, in response to determining that the first bandwidth of the communication link is greater than the threshold bandwidth, provides the first copy of the directional audio data 152, the first copy of the directional audio data 154, or both, as the output stream 150 to the stream selector 142. As another example, the stream generator 140, in response to determining that the first bandwidth of the communication link is less than or equal to the threshold bandwidth, provides the second copy of the directional audio data 152, the second copy of the directional audio data 154, or both, as the output stream 150 to the stream selector 142.

In a particular implementation, the stream generator 140 provides one or more of the directional audio data 152, the directional audio data 154, the one or more additional sets of directional audio data, or a combination thereof, as the output stream 150 based on the capabilities, conditions, or both, of the communication link with the stream selector 142. For example, the stream generator 140, in response to determining that the first bandwidth of the communication link is less than or equal to the threshold bandwidth, provides one of the directional audio data 152, the directional audio data 154, the one or more additional sets of directional audio data, or a combination thereof, as the output stream 150 to the stream selector 142. As another example, the stream generator 140, in response to determining that the first bandwidth of the communication link is greater than the threshold bandwidth, provides more than one of the directional audio data 152, the directional audio data 154, the one or more additional sets of directional audio data, or a combination thereof, as the output stream 150 to the stream selector 142.

In a particular implementation, the stream generator 140 provides one of the directional audio data 152, the directional audio data 154, the one or more additional sets of directional audio data, or a combination thereof, as the output stream 150 based on the capabilities, conditions, or both, of the communication link with the stream selector 142. For example, the stream generator 140, in response to determining that the first bandwidth of the communication link is less than or equal to the threshold bandwidth, provides one of the directional audio data 152, the directional audio data 154, the one or more additional sets of directional audio data, or a combination thereof, as the output stream 150 to the stream selector 142. As another example, the stream generator 140, in response to determining that the first bandwidth of the communication link is greater than the threshold bandwidth, provides another of the directional audio data 152, the directional audio data 154, the one or more additional sets of directional audio data, or a combination thereof, as the output stream 150 to the stream selector 142.

Figure 2A:
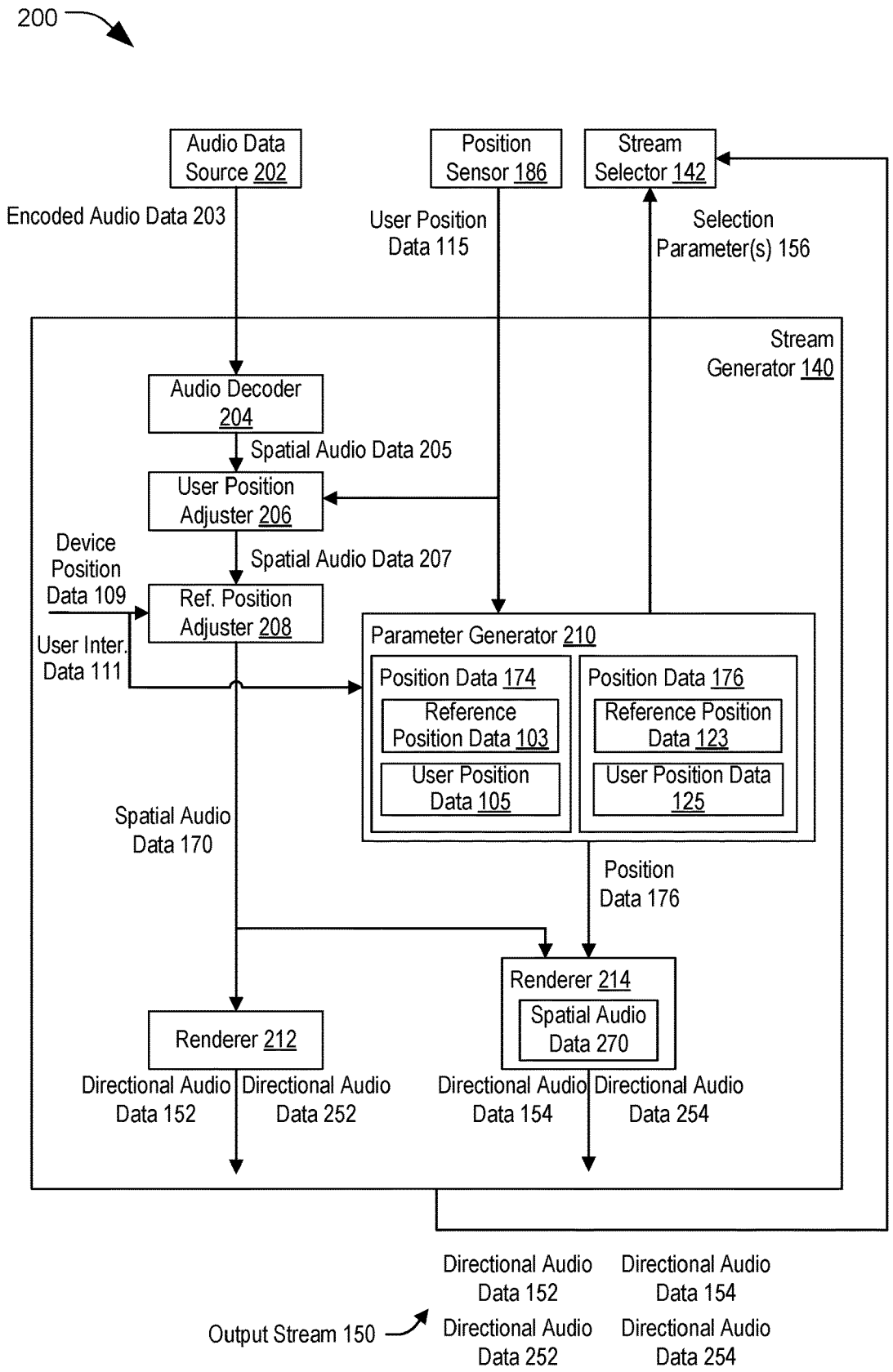
FIG. 2A is a diagram of an illustrative aspect of operation of a stream generator of FIG. 1, in accordance with some examples of the present disclosure.

Referring to FIG. 2A, a diagram 200 of an illustrative aspect of operation of the stream generator 140 is shown. In a particular aspect, the stream generator 140 is coupled to an audio data source 202 (e.g., a memory, a server, a storage device, or another audio data source). In a particular aspect, the audio data source 202 is external to the device 102 of FIG. 1. For example, the device 102 includes a modem configured to receive audio data from the audio data source 202. In an alternate aspect, the audio data source 202 is integrated in the device 102.

The stream generator 140 includes an audio decoder 204 coupled via a user position adjuster 206 to a reference position adjuster 208. The reference position adjuster 208 is coupled to one or more renderers, such as a renderer 212, a renderer 214, one or more additional renderers, or a combination thereof. The stream generator 140 also includes a parameter generator 210 coupled to at least one renderer, such as the renderer 214, one or more additional renderers, or a combination thereof.

Figure 2B:
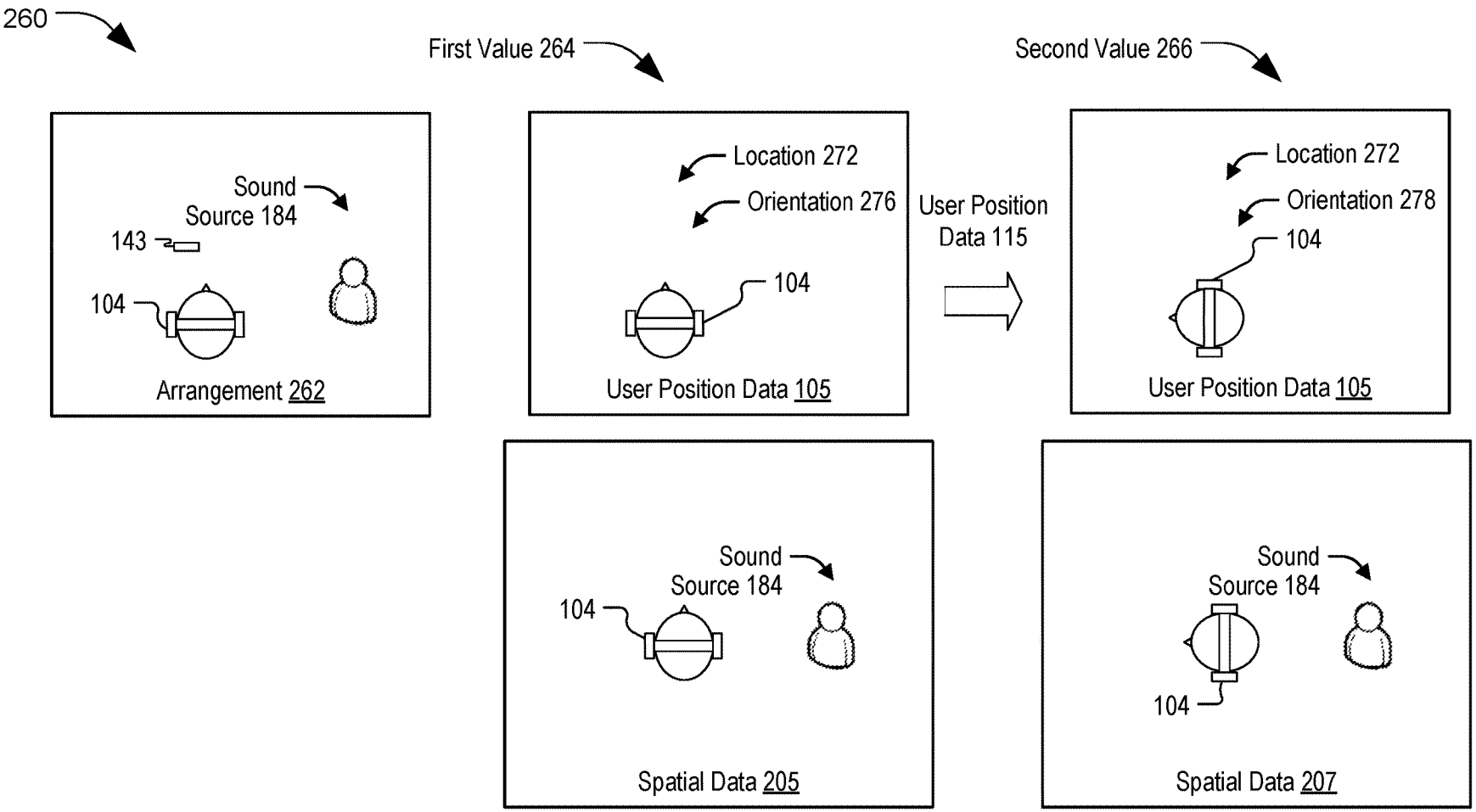
FIG. 2B is a diagram of an illustrative aspect of data generated by the stream generator of FIG. 1, in accordance with some examples of the present disclosure.

In a particular aspect, the audio decoder 204 receives encoded audio data 203 from the audio data source 202. The audio decoder 204 decodes the encoded audio data 203 to generate spatial audio data 205. In FIG. 2B, a diagram 260 illustrates examples of data generated by the stream generator 140. For example, previous spatial audio data has an arrangement 262. A first value 264 of the user position data 105 indicates a previous position of the user of the device 104 corresponding to the arrangement 262. For example, the first value 264 indicates a location 272 (e.g., first location coordinates) and an orientation 276 (e.g., North) of the user of the device 104. The spatial audio data 205 corresponds to a first position of a sound source 184 relative to (e.g., to the right of) a listener.

The stream generator 140 receives the user position data 115 from the position sensor 186. The user position data 115 indicates a change in position of the user of the device 104. In a particular implementation, the user position data 115 indicates that the user of the device 104 changed orientation (e.g., turned anti-clockwise) by a particular amount (e.g., 90 degrees) while staying at the same location (e.g., no displacement). The user position adjuster 206 determines, based on the orientation 276 (e.g., facing North) and the orientation change (e.g., 90 degrees anti-clockwise) indicated by the user position data 115, that the user has moved from the orientation 276 to an orientation 278 (e.g., facing West). The user position adjuster 206 determines based on the location 272 and the displacement (e.g., none) indicated by the user position data 115, that the user remains at the same location (e.g., the location 272). In another implementation, the user position data 115 indicates that the user of the device 104 has the orientation 278 (e.g., facing West) at the location 272. The user position adjuster 206 determines, based on a comparison of the first value 264 of the user position data 105 and the user position data 115, that the user has changed orientation (e.g., turned anti-clockwise by 90 degrees) while staying at the same location (e.g., no displacement).

The user position adjuster 206 generates the spatial audio data 207 by adjusting the spatial audio data 205 based on the change in user position (e.g., orientation change, displacement, or both) indicated by the user position data 115, the first value 264 of the user position data 105, or both. For example, the user position adjuster 206 generates the spatial audio data 207 by adjusting the spatial audio data 205 based on the change in user position such that the sound source 184 has a second position relative to (e.g., behind) the listener.

The user position adjuster 206 determines (e.g., updates) the user position data 105 based on the user position data 115. For example, the user position adjuster 206 updates the user position data 105 to a second value 266 indicating the location 272, the orientation 278, or both. In a particular aspect, the user position adjuster 206 provides the user position data 105 (e.g., the second value 266) to the parameter generator 210.

Figure 2C:
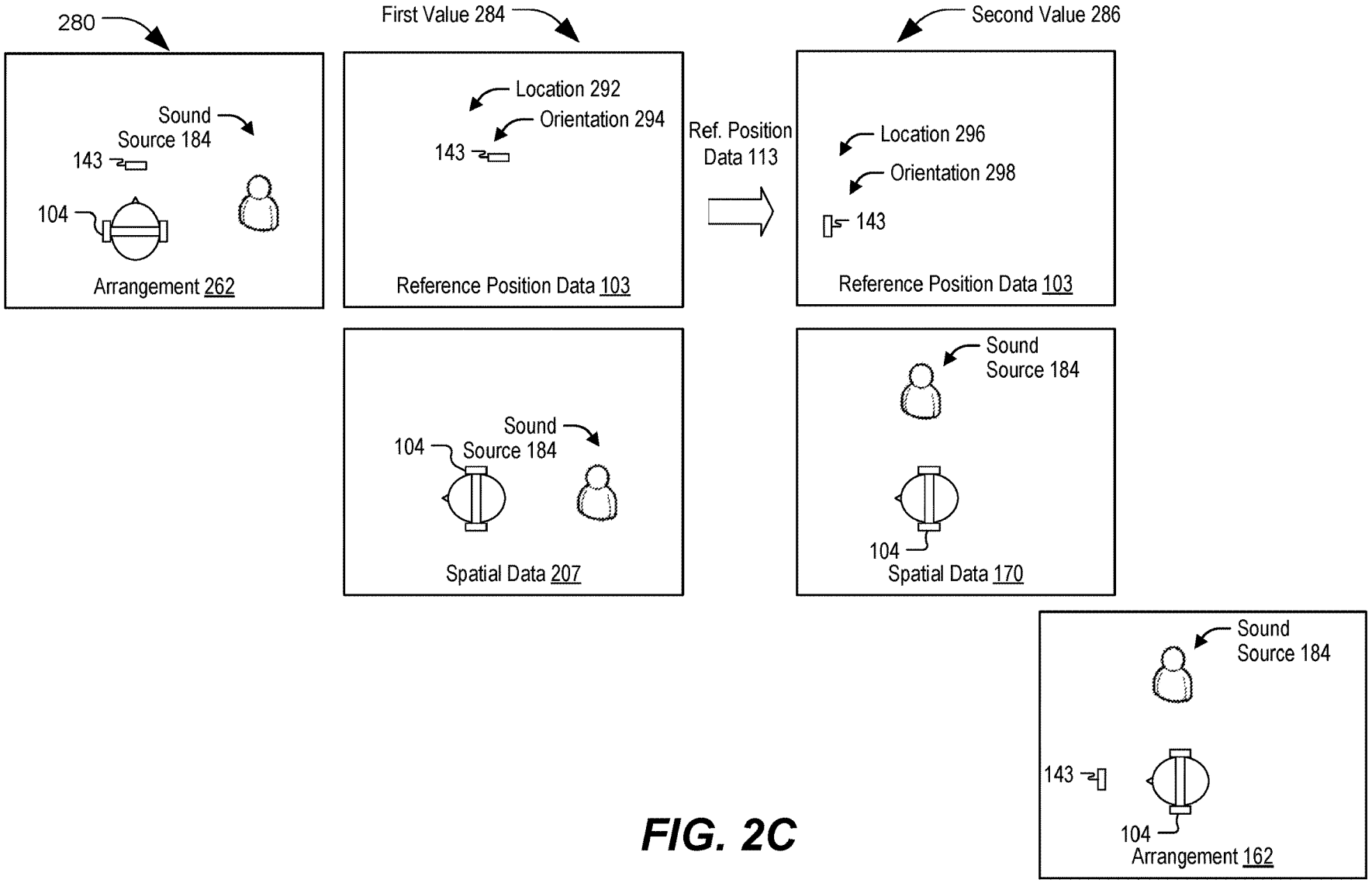
FIG. 2C is a diagram of another illustrative aspect of data generated by the stream generator of FIG. 1, in accordance with some examples of the present disclosure.

The user position adjuster 206 provides the spatial audio data 207 to the reference position adjuster 208. In FIG. 2C, a diagram 280 illustrates additional examples of data generated by the stream generator 140. For example, a first value 284 of the reference position data 103 indicates a previous position of the reference point 143 corresponding to the arrangement 262 (e.g., associated with previous spatial audio data). To illustrate, the first value 284 indicates a location 292 (e.g., second location coordinates) and an orientation 294 (e.g., facing South) of the reference point 143.

The reference position adjuster 208 obtains the reference position data 113 (e.g., the device position data 109, the virtual reference position data 107 indicated by the user interactivity data 111, or both). The reference position data 113 indicates a change in position of the reference point 143. In a particular implementation, the reference position data 113 indicates that the reference point 143 changed orientation (e.g., turned anti-clockwise by 90 degrees) and had a first displacement (e.g., moved a first distance to the West and a second distance to the South). The reference position adjuster 208 determines, based on the orientation 294 (e.g., facing South) and the orientation change (e.g., 90 degrees anti-clockwise) indicated by the reference position data 113, that the reference point 143 has moved from the orientation 294 to an orientation 298 (e.g., facing East). The reference position adjuster 208 determines based on the location 292 and the displacement (e.g., a first distance West and a second distance South) indicated by the reference position data 113, that the reference point 143 has moved from the location 292 to a location 296 (e.g., third location coordinates). In another implementation, the reference position data 113 indicates that the reference point 143 has the orientation 298 (e.g., facing East) at the location 296. The reference position adjuster 208 determines, based on a comparison of the first value 284 of the reference position data 103 and the reference position data 113, that the reference point 143 has changed orientation (e.g., turned anti-clockwise by 90 degrees) and had the first displacement (e.g., moved a first distance to the West and a second distance to the South).

The reference position adjuster 208 generates the spatial audio data 170 by adjusting the spatial audio data 207 based on the position change (e.g., orientation change, displacement, or both) of the reference point 143 indicated by the reference position data 113, the first value 284 of the reference position data 103, or both. For example, the reference position adjuster 208 generates the spatial audio data 170 by adjusting the spatial audio data 207 based on the change in reference point position such that the sound source 184 has the position 192 relative to (e.g., left of) the reference point 143.

The reference position adjuster 208 determines (e.g., updates) the reference position data 103 based on the reference position data 113. For example, the reference position adjuster 208 updates the reference position data 103 to a second value 286 indicating the location 296, the orientation 298, or both. In a particular aspect, the reference position adjuster 208 provides the reference position data 103 (e.g., the second value 286) to the parameter generator 210.

Returning to FIG. 2A, the parameter generator 210 generates one or more selection parameters 156 indicating that the spatial audio data 170 is associated with the position data 174 (e.g., the second value 286 of the reference position data 103, the second value 266 of the user position data 105, or both). The parameter generator 210 generates one or more sets of position data (e.g., predicted position data, predetermined position data, or both). For example, the parameter generator 210 generates the position data 176 indicating the reference position data 123, the user position data 125, or both, as further described with reference to FIG. 3. In some examples, the parameter generator 210 generates one or more additional sets of position data. The parameter generator 210 provides each of the sets of position data to a particular renderer. For example, the parameter generator 210 provides the position data 176 to the renderer 214, an additional set of position data to an additional renderer, or both.

The reference position adjuster 208 provides the spatial audio data 170 to the one or more renderers (e.g., the renderer 212, the renderer 214, one or more additional renderers, or a combination thereof). The renderer 212 generates one or more sets of directional audio data based on the spatial audio data 170. For example, the renderer 212 performs binaural processing on the spatial audio data 170 to generate the directional audio data 152 corresponding to a first channel (e.g., a right channel) and directional audio data 252 corresponding to a second channel (e.g., a left channel). The spatial audio data 170 is associated with the position data 174 (e.g., detected position data, default position data, or both).

The renderer 214 generates spatial audio data 270 by adjusting the spatial audio data 170 based on the position data 174 and the position data 176. In a particular aspect, the spatial audio data 170 represents sound from the sound source 184 that is to be perceived to be coming from the position 192 (e.g., to the left and from a particular distance) relative to the reference point 143. The spatial audio data 170 corresponds to the arrangement 162 of the sound source 184 relative to a listener (e.g., the user of the device 104), as described with reference to FIGS. 1 and 2C. The renderer 214 generates the spatial audio data 270 to have the arrangement 164 of FIG. 1 such that the sound from the sound source 184 is perceived to be coming from a particular direction (e.g., front) of the listener (e.g., the user of the device 104) when the spatial audio data 270 is played out so that the sound would be perceived to be coming from the position 192 relative to the reference point 143 when the user has the user position indicated by the user position data 125 and the reference point 143 has the reference position indicated by the reference position data 123.

The renderer 214 generates one or more sets of directional audio data based on the spatial audio data 270. For example, the renderer 214 performs binaural processing on the spatial audio data 270 to generate the directional audio data 154 corresponding to a first channel (e.g., a right channel) and directional audio data 254 corresponding to a second channel (e.g., a left channel). The spatial audio data 270 is associated with the position data 176 (e.g., predicted position data, predetermined position data, or both).

In some examples, the one or more additional renderers generate additional sets of directional audio data. For example, an additional renderer generates particular spatial audio data by adjusting the spatial audio data 170 based on the position data 174 and particular position data. The particular spatial audio data corresponds to a particular sound arrangement. The additional renderer 214 generates one or more additional sets of directional audio data based on the particular spatial audio data. For example, the additional renderer performs binaural processing on the particular spatial audio data to generate first directional audio data corresponding to a first channel (e.g., a right channel) and second directional audio data corresponding to a second channel (e.g., a left channel).

The stream generator 140 provides the directional audio data 152, the directional audio data 252, the directional audio data 154, the directional audio data 254, one or more additional sets of directional audio data, or a combination thereof, as the output stream 150 to the stream selector 142. In a particular aspect, the stream generator 140 provides the one or more selection parameters 156 to the stream selector 142 concurrently with providing the output stream 150 to the stream selector 142. The one or more selection parameters 156 indicate that the directional audio data 152, the directional audio data 252, or both, are associated with the position data 174. The one or more selection parameters 156 indicate that the directional audio data 154, the directional audio data 254, or both, are associated with the position data 176. In some examples, the one or more selection parameters 156 indicate that one or more additional sets of directional audio data are associated with additional position data.

Figure 3:
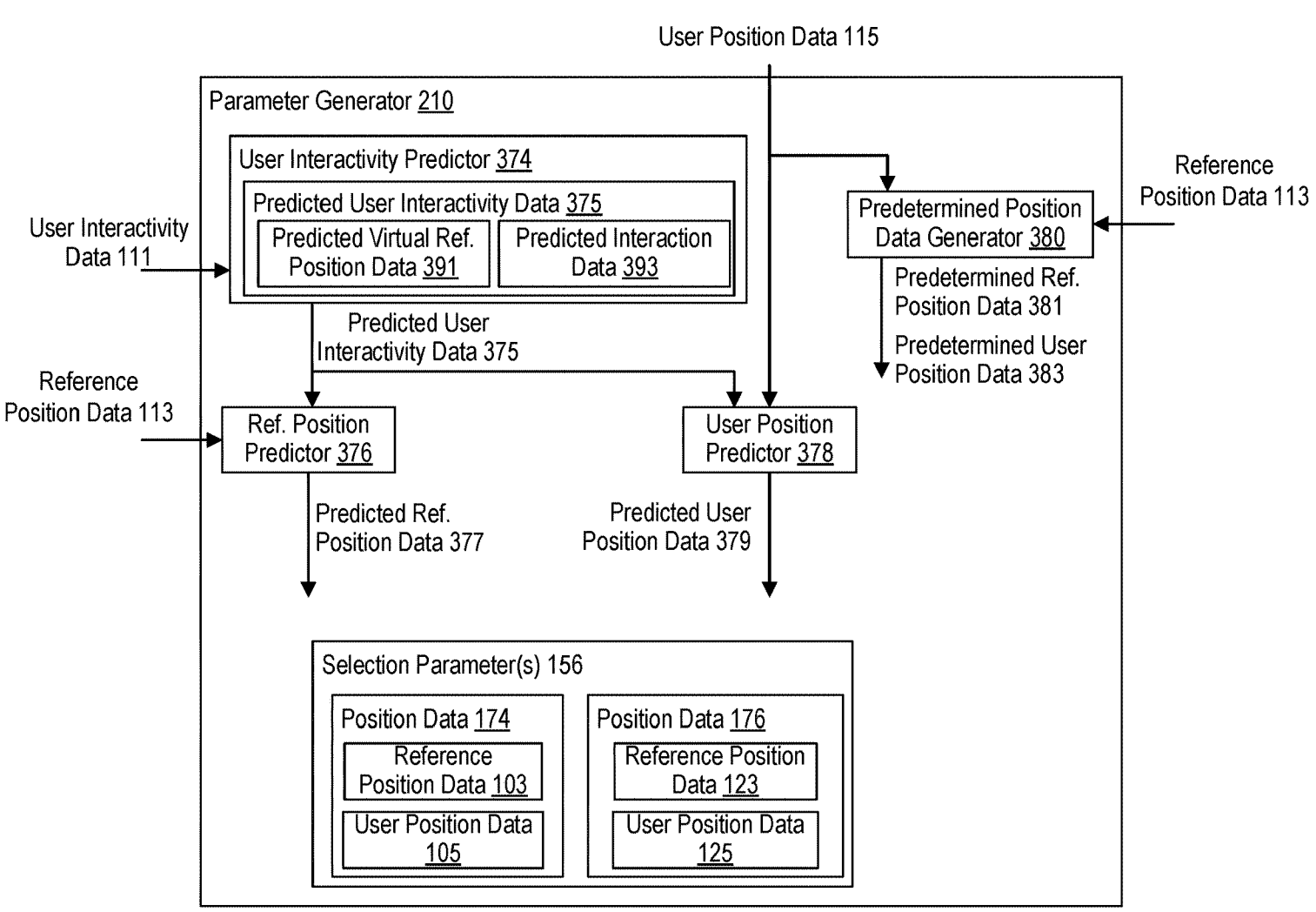
FIG. 3 is a diagram of an illustrative aspect of operation of a parameter generator of the stream generator of FIG. 2A, in accordance with some examples of the present disclosure.

Referring to FIG. 3, a diagram 300 of an illustrative aspect of operation of the parameter generator 210 is shown. In a particular aspect, the parameter generator 210 includes a user interactivity predictor 374 coupled to a reference position predictor 376, a user position predictor 378, or both. In a particular aspect, the parameter generator 210 includes a predetermined position data generator 380.

The user interactivity predictor 374 is configured to generate predicted user interactivity data 375 by processing the user interactivity data 111. In a particular implementation, the user interactivity predictor 374 determines predicted interaction data 393 based on the user interactivity data 111 that includes application data indicating future events, application data history, or a combination thereof. To illustrate, the predicted interaction data 393 indicates that an event (e.g., an explosion at a particular virtual location in a video game) is predicted to occur. In a particular aspect, the user interactivity predictor 374 (e.g., a neural network) generates predicted virtual reference position data 391 based on the virtual reference position data 107 indicated by the user interactivity data 111, the predicted interaction data 393, or both. The predicted virtual reference position data 391 indicates a predicted position of the reference point 143 (e.g., a virtual reference point). In a particular aspect, the user interactivity predictor 374 provides the predicted user interactivity data 375 to the reference position predictor 376, the user position predictor 378, or both.

The reference position predictor 376 determines predicted reference position data 377 based on the reference position data 113, the predicted virtual reference position data 391, the predicted interaction data 393, or a combination thereof. The predicted reference position data 377 indicates a predicted position (e.g., an absolute position or a change in position) of the reference point 143. In a particular aspect, the reference point 143 includes a virtual reference point, and the predicted reference position data 377 indicates the predicted virtual reference position data 391. In a particular aspect, the reference point 143 corresponds to a fixed reference point (e.g., a television) and the predicted reference position data 377 indicates that the reference point 143 is predicted to have the same position as indicated by the reference position data 113. In a particular aspect, the reference point 143 is movable and the reference position predictor 376 tracks movement of the reference point 143 based on the reference position data 113, previous reference position data, or a combination thereof, to generate the predicted reference position data 377.

The user position predictor 378 determines predicted user position data 379 based on the user position data 115, the predicted reference position data 377, the predicted interaction data 393, or a combination thereof. The predicted user position data 379 indicates a predicted position (e.g., an absolute position or a change in position) of the user of the device 104. In a particular aspect, the user position predictor 378 determines the predicted user position data 379 based on an event predicted by the predicted interaction data 393, a predicted position of the reference point 143 indicated by the predicted reference position data 377, or both. For example, the predicted user position data 379 generates the user position predictor 378 to indicate that the user is predicted to move away from the predicted event (e.g., an explosion in a video game), that the user is predicted follow the reference point 143 (e.g., a NPC), or both. In a particular aspect, the user position predictor 378 tracks movement of the user of the device 104 based on the user position data 115, previous user position data, or a combination thereof, to generate the predicted user position data 379.

The predetermined position data generator 380 is configured to generate predetermined position data (e.g., predetermined reference position data 381, predetermined user position data 383, or both). In a particular aspect, the predetermined position data generator 380 generates the predetermined reference position data 381 based on the reference position data 113 and a predetermined set of values. For example, the predetermined position data generator 380 generates a predetermined reference orientation of the predetermined reference position data 381 by incrementing (or decrementing) a reference orientation indicated by the reference position data 113 by a predetermined orientation (e.g., 10 degrees) indicated by the predetermined set of values. As another example, the predetermined position data generator 380 generates a predetermined reference location of the predetermined reference position data 381 by incrementing (or decrementing) a reference location indicated by the reference position data 113 by a predetermined displacement (e.g., a particular distance in a particular direction) indicated by the predetermined set of values.

In a particular aspect, the predetermined position data generator 380 generates the predetermined user position data 383 based on the user position data 115 and a predetermined set of values. For example, the predetermined position data generator 380 generates a predetermined reference orientation of the predetermined reference position data 381 by incrementing (or decrementing) a reference orientation indicated by the reference position data 113 by a predetermined orientation (e.g., 10 degrees) indicated by the predetermined set of values. As another example, the predetermined position data generator 380 generates a predetermined reference location of the predetermined reference position data 381 by incrementing (or decrementing) a reference location indicated by the reference position data 113 by a predetermined displacement (e.g., a particular distance in a particular direction) indicated by the predetermined set of values.

In a particular aspect, the parameter generator 210 generates the position data 176 based on the predicted reference position data 377, the predicted user position data 379, the predetermined reference position data 381, the predetermined user position data 383, or a combination thereof. For example, the reference position data 123 is based on the predicted reference position data 377, the predetermined reference position data 381, or both. In a particular example, the user position data 125 is based on the predicted user position data 379, the predetermined user position data 383, or both.

In a particular aspect, the parameter generator 210 generates one or more additional sets of position data, and the selection parameters 156 include the one or more additional sets of position data. In some examples, the reference position predictor 376 generates multiple sets of predicted reference position data corresponding to multiple predicted reference positions, the user position predictor 378 generates multiple sets of predicted user position data corresponding to multiple predicted user positions, or both. The parameter generator 210 generates multiple sets of position data based on the multiple predicted reference positions, the multiple predicted user positions, or a combination thereof. In some examples, the predetermined position data generator 380 generates multiple sets of predetermined reference position data corresponding to multiple predetermined reference positions and multiple sets of predetermined user position data corresponding to multiple predetermined user positions. The parameter generator 210 generates multiple sets of position data based on the multiple predetermined reference positions, the multiple predetermined user positions, or a combination thereof.

Figure 4:
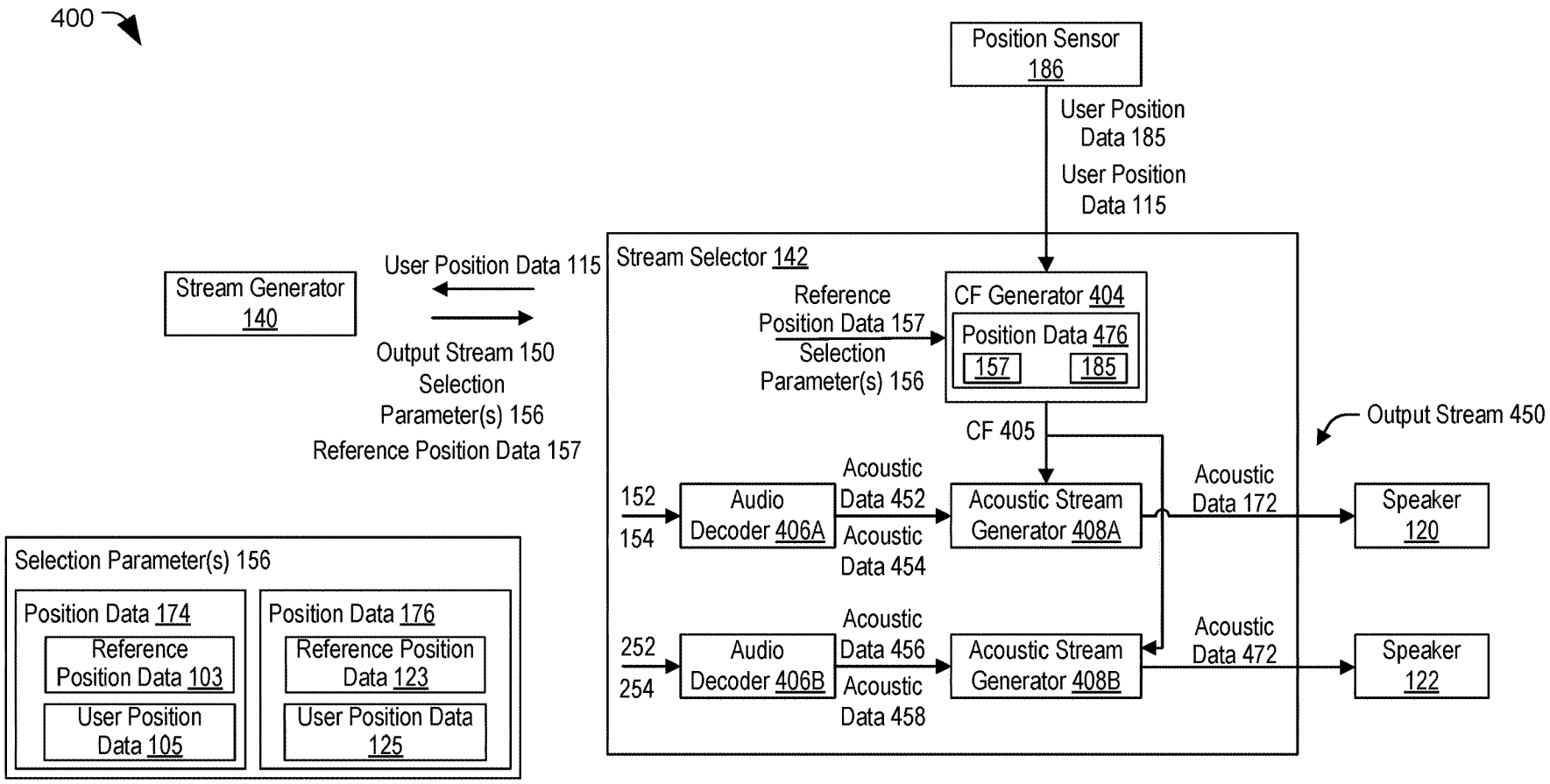
FIG. 4 is a diagram of an illustrative aspect of operation of a stream selector of FIG. 1, in accordance with some examples of the present disclosure.

Referring to FIG. 4, a diagram 400 of an illustrative aspect of operation of the stream selector 142 is shown. The stream selector 142 includes a combination factor (CF) generator 404 and one or more audio decoders (e.g., an audio decoder 406A, an audio decoder 406B, one or more additional audio decoders, or a combination thereof). The combination factor generator 404 is coupled to each of one or more acoustic stream generators (e.g., an acoustic stream generator 408A, an acoustic stream generator 408B, one or more additional acoustic stream generators, or a combination thereof). The one or more audio decoders are coupled to the one or more acoustic stream generators. For example, the audio decoder 406A is coupled to the acoustic stream generator 408A. As another example, the audio decoder 406B is coupled to the acoustic stream generator 408B.

The stream selector 142 receives the user position data 115 from the position sensor 186 indicating a position of the device 104, a user of the device 104, or both, detected at a first user position time. The stream selector 142 provides the user position data 115 to the stream generator 140 at a first time. The stream selector 142 receives the output stream 150, the one or more selection parameters 156, or a combination thereof, at a second time that is subsequent to the first time.

In a particular aspect, the output stream 150 includes the directional audio data 152 (e.g., right channel data) and the directional audio data 252 (e.g., left channel data) that are based on the position data 174 (e.g., detected position data, default position data, or both). In a particular aspect, the output stream 150 includes the directional audio data 154 (e.g., right channel data) and the directional audio data 254 (e.g., left channel data) that are based on the position data 176 (e.g., predetermined position data, predicted position data, or both). In some examples, the output stream 150 includes additional sets of directional audio data based on additional sets of position data.

In a particular aspect, the audio decoder 406A decodes the directional audio data for a first audio channel (e.g., right channel), and the audio decoder 406B decodes the directional audio data for a second audio channel (e.g., left channel). For example, the audio decoder 406A decodes the directional audio data 152 to generate acoustic data 452, decodes the directional audio data 154 to generate acoustic data 454, decodes additional directional audio data to generate additional acoustic data, or a combination thereof. The audio decoder 406B decodes the directional audio data 252 to generate acoustic data 456, decodes the directional audio data 254 to generate acoustic data 458, decodes additional directional audio data to generate additional acoustic data, or a combination thereof. In some examples, additional audio decoders decode directional audio data for additional audio channels.

The combination factor generator 404 receives the user position data 185 from the position sensor 186 indicating a position of the device 104, a user of the device 104, or both, detected at a second user position time that is subsequent to the first user position time associated with the user position data 115. In a particular aspect, the combination factor generator 404 receives the reference position data 157 from the stream generator 140. For example, the reference position data 157 corresponds to an updated position (e.g., a detected position) of the reference point 143 relative to the position of the reference point 143 indicated by the reference position data 103.

The combination factor generator 404 generates a combination factor 405 based on position data 476 (e.g., the user position data 185, the reference position data 157, or both), the one or more selection parameters 156, or a combination thereof. In a particular aspect, the position data 174 corresponds to previously detected position data or default position data, the position data 176 corresponds to predetermined position data or predicted position data, and the position data 476 corresponds to recently detected position data. In a particular aspect, the one or more selection parameters 156 include additional sets of position data (e.g., corresponding to additional predetermined positions, additional predicted positions, or a combination thereof).

The combination factor generator 404 generates the combination factor 405 based on a comparison of the position data 476 with the position data 174, the position data 176, one or more additional sets of position data, or a combination thereof. In a particular aspect, the combination factor generator 404 determines a first reference difference based on a comparison of a reference position (e.g., a default reference position or a previously detected reference position) indicated by the reference position data 103 and a reference position (e.g., a recently detected reference position) indicated by the reference position data 157. The combination factor generator 404 determines a second reference difference based on a comparison of a reference position (e.g., a predetermined reference position or a predicted reference position) indicated by the reference position data 123 and the reference position (e.g., the recently detected reference position) indicated by the reference position data 157. The combination factor generator 404 determines a first user difference based on a comparison of a user position (e.g., a default user position or a previously detected user position) indicated by the user position data 105 and a user position (e.g., a recently detected user position) indicated by the user position data 185. The combination factor generator 404 determines a second user difference based on a comparison of a user position (e.g., a predetermined user position or a predicted user position) indicated by the user position data 125 and the user position (e.g., the recently detected user position) indicated by the user position data 185.

The combination factor generator 404 generates a first difference indicator based on the first reference difference, the first user difference, or both. The combination factor generator 404 generates a second difference indicator based on the second reference difference, the second user difference, or both. The first difference indicator indicates a level of difference between the position data 174 and the position data 476. The second difference indicator indicates a level of difference between the position data 176 and the position data 476. In a particular aspect, the combination factor generator 404 generates one or more additional difference indicators based on the one or more additional sets of position data.

In a particular implementation, the combination factor generator 404 generates the combination factor 405 to have a first value (e.g., 0) based on determining that the position data 476 is a closer or equal match to the position data 174 than to the position data 176. For example, the combination factor generator 404 generates the combination factor 405 to have the first value (e.g., 0) in response to determining that the first difference indicator indicates a lower or equal level of difference than indicated by the second difference indicator (e.g., first difference indicator≤second difference indicator). Alternatively, the combination factor generator 404 generates the combination factor 405 to have a second value (e.g., 1) based on determining that the position data 476 is a closer match to the position data 176 than to the position data 174. For example, the combination factor generator 404 generates the combination factor 405 to have a second value (e.g., 1) in response to determining that the first difference indicator indicates a greater level of difference than indicated by the first difference indicator (e.g., first difference indicator>second difference indicator).

In an alternative implementation, the combination factor generator 404 generates the combination factor 405 to be greater than or equal to a first value (e.g., 0) and less than or equal to a second value (e.g., 1) based on a relative difference of the position data 476 to the position data 174 and the position data 176. For example, the combination factor generator 404 generates the combination factor 405 to have a value based on a ratio of the first difference indicator and the second difference indicator (e.g., combination factor 405=first difference indicator/(first difference indicator+second difference indicator)). In a particular aspect, the combination factor generator 404 generates the combination factor 405 to have a particular value corresponding to an additional set of position data that is a closer or equal match to the position data 476 as compared to other sets of position data.

The combination factor generator 404 provides the combination factor 405 to each of the acoustic stream generator 408A and the acoustic stream generator 408B. In a particular aspect, an acoustic stream generator 408, in response to determining that the combination factor 405 has a particular value, selects acoustic data corresponding to the position data that is associated with the particular value of the combination factor 405. In a particular implementation, an acoustic stream generator 408, in response to determining that the combination factor 405 has the first value (e.g., 0), selects audio data associated with the position data 174. For example, the acoustic stream generator 408A, in response to determining that the combination factor 405 has the first value (e.g., 0), selects the acoustic data 452 associated with the position data 174 as the acoustic data 172. The acoustic stream generator 408B, in response to determining that the combination factor 405 has the first value (e.g., 0), selects the acoustic data 456 associated with the position data 174 as acoustic data 472. Alternatively, the acoustic stream generator 408, in response to determining that the combination factor 405 has the second value (e.g., 1) selects audio data associated with the position data 176. For example, the acoustic stream generator 408A, in response to determining that the combination factor 405 has a second value (e.g., 1), selects the acoustic data 454 associated with the position data 176 as the acoustic data 172. The acoustic stream generator 408B, in response to determining that the combination factor 405 has the second value (e.g., 1), selects the acoustic data 458 associated with the position data 176 as acoustic data 472.

In a particular implementation, an acoustic stream generator 408 combines, based on the combination factor 405, the audio data associated with the sets of position data (e.g., audio data associated with the position data 174, audio data associated with the position data 176, audio data associated with one or more additional sets of position data, or a combination thereof). In a particular example, the acoustic stream generator 408A generates a first weight based on the combination factor 405 (e.g., first weight=1−combination factor 405) and a second weight based on the combination factor 405 (e.g., second weight=combination factor 405). The acoustic stream generator 408A generates the acoustic data 172 based on a weighted sum of the acoustic data 452 and the acoustic data 454. For example, the acoustic data 172 corresponds to a combination of the first weight applied to the acoustic data 452 and the second weight applied to the acoustic data 454 (e.g., acoustic data 172=first weight (acoustic data 452)+second weight (acoustic data 454)).

In a particular example, the acoustic stream generator 408B generates the first weight based on the combination factor 405 (e.g., first weight=1−combination factor 405) and the second weight based on the combination factor 405 (e.g., second weight=combination factor 405). The acoustic stream generator 408B generates the acoustic data 472 based on a weighted sum of the acoustic data 456 and the acoustic data 458. For example, the acoustic data 472 corresponds to a combination of the first weight applied to the acoustic data 456 and the second weight applied to the acoustic data 458 (e.g., acoustic data 472=first weight (acoustic data 456)+second weight (acoustic data 458)).

In a particular aspect, the stream selector 142 enables generation of the acoustic data 172 such that a difference of the acoustic data 172 to the acoustic data 452 (corresponding to the directional audio data 152) and the acoustic data 454 (corresponding to the directional audio data 154) corresponds to a difference of the position data 476 to the position data 174 and the position data 176. For example, the acoustic data 172 is closer to the acoustic data 452 (e.g., based on the position data 174) when the position data 476 (e.g., recently detected position data) is closer to the position data 174 (e.g., previously detected position data or default position data). Alternatively, the acoustic data 172 is closer to the acoustic data 454 (e.g., based on the position data 176) when the position data 476 (e.g., recently detected position data)

is closer to the position data 176 (e.g., predetermined position data or predicted position data).

The stream selector 142 outputs the acoustic data 172 and the acoustic data 472 as an output stream 450 to one or more speakers. For example, the stream selector 142, in response to determining that the acoustic data 172 is associated with a first channel (e.g., right channel) outputs the acoustic data 172 to the speaker 120 associated with the first channel. As another example, the stream selector 142, in response to determining that the acoustic data 472 is associated with a second channel (e.g., left channel) outputs the acoustic data 472 to the speaker 122 associated with the second channel.

In a particular aspect, the stream selector 142 receives the output stream 150 from the stream generator 140 prior to receiving the user position data 185, the reference position data 157, or both. The stream selector 142 can thus generate the output stream 450 upon receiving the position data 476 without latency associated with generating the directional audio data 152, the directional audio data 154, or both. In a particular aspect, generating the acoustic data 172 based on the acoustic data 452 and the acoustic data 454 uses fewer resources as compared to generating one of the directional audio data 152 or the directional audio data 154 based on the spatial audio data 170 and the position data 476. Having the stream generator 140 on the device 102 thus offloads some processing from the device 104.

Figure 5:
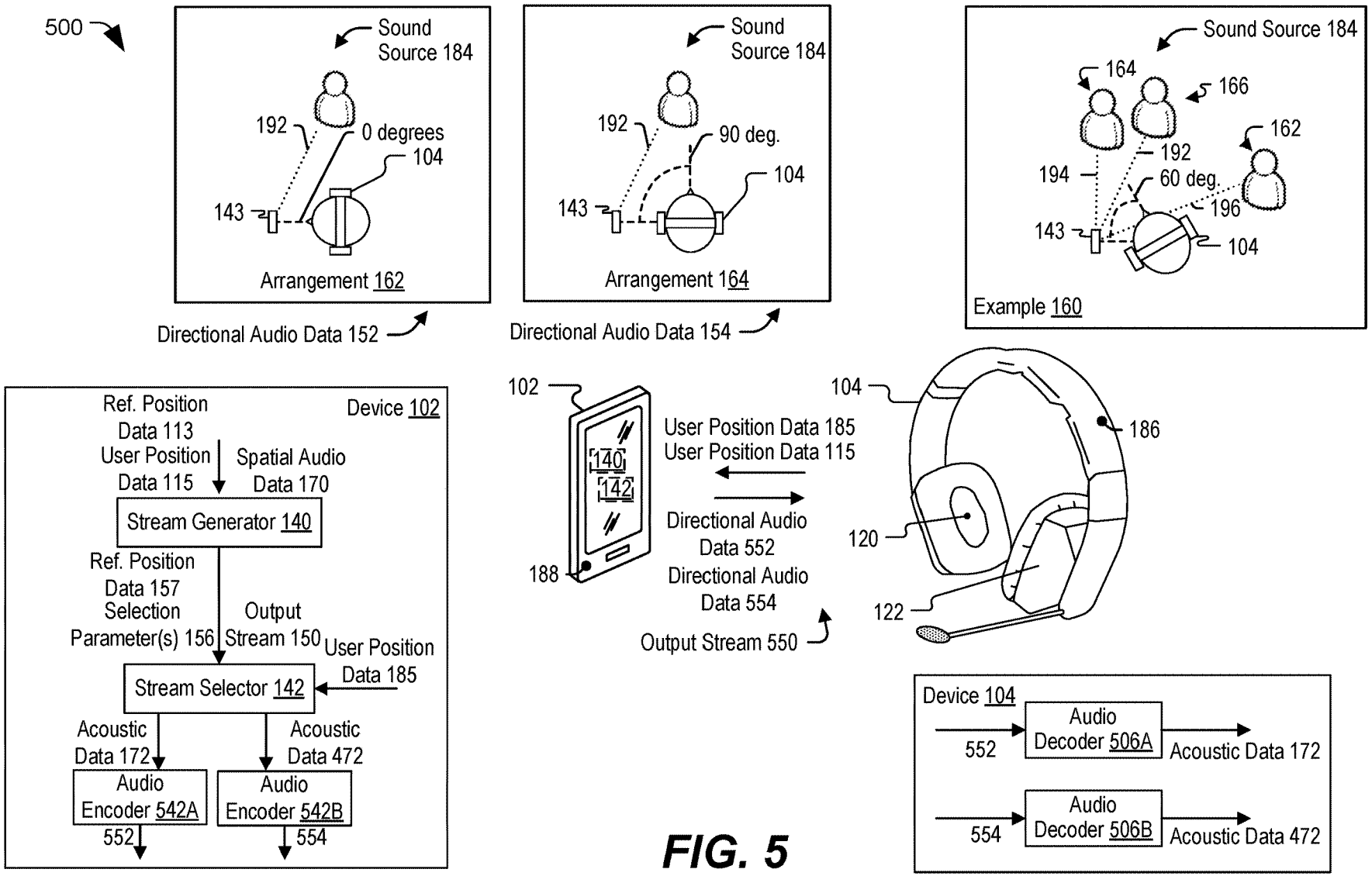
FIG. 5 is a diagram of another illustrative aspect of a system operable to generate directional audio with multiple sound source arrangements, in accordance with some examples of the present disclosure.

Referring to FIG. 5, a system 500 operable to generate directional audio with multiple sound source arrangements is shown. The device 102 (e.g., a host device) includes the stream generator 140 coupled via the stream selector 142 to one or more audio encoders (e.g., an audio encoder 542A, an audio encoder 542B, one or more additional audio encoders, or a combination thereof). The device 104 includes one or more audio decoders, e.g., an audio decoder 506A, an audio decoder 506B, one or more additional audio decoders, or a combination thereof.

The device 104 provides the user position data 115 to the device 102 at a first time. The stream generator 140 generates the output stream 150, the one or more selection parameters 156, or a combination thereof, based on the spatial audio data 170, the reference position data 113, the user position data 115, or a combination thereof, as described with reference to FIG. 2A. The stream generator 140 provides the output stream 150, the one or more selection parameters 156, or a combination thereof, to the stream selector 142.

The stream selector 142 receives the output stream 150, the one or more selection parameters 156, or a combination thereof, from the stream generator 140. The device 104 provides the user position data 185 to the device 102 at a second time that is subsequent to the first time. In a particular aspect, the stream selector 142 receives the reference position data 157 from the stream generator 140. In an alternative aspect, the stream selector 142 determines the reference position data 157. For example, the stream selector 142 receives the user interactivity data 111 indicating second virtual reference position data of the reference point 143 (e.g., a virtual reference point) and determines the reference position data 157 based at least in part on the second virtual reference position data. In a particular example, the stream selector 142 receives second device position data from the position sensor 188 and determines the reference position data 157 based at least in part on the second device position data.

The stream selector 142 generates the acoustic data 172, the acoustic data 472, or both, based on the output stream 150, the one or more selection parameters 156, the position data 476 (e.g., the reference position data 157, the user position data 185, or both), or a combination thereof, as described with reference to FIG. 4. In a particular implementation, the stream selector 142 does not include the audio decoder 406A or the audio decoder 406B. In this implementation, the stream selector 142 provides the directional audio data 152 as the acoustic data 452 and the directional audio data 154 as the acoustic data 454 to the acoustic stream generator 408A. The stream selector 142 provides the directional audio data 252 as the acoustic data 456 and the directional audio data 254 as the acoustic data 458 to the acoustic stream generator 408B. The acoustic stream generator 408A combines the directional audio data 152 (e.g., the acoustic data 452) and the directional audio data 154 (e.g., the acoustic data 454) based on the combination factor 405 to generate the acoustic data 172. In a particular aspect, the acoustic stream generator 408A selects, based on the combination factor 405, one of the directional audio data 152 (e.g., the acoustic data 452) or the directional audio data 154 (e.g., the acoustic data 454) as the acoustic data 172. Similarly, the acoustic stream generator 408B generates the acoustic data 472 based on the directional audio data 252 and the directional audio data 254.

The stream selector 142 provides the acoustic data 172 to the audio encoder 542A, provides the acoustic data 472 to the audio encoder 542B, or both. The audio encoder 542A generates directional audio data 552 by encoding the acoustic data 172. The audio encoder 542B generates directional audio data 554 by encoding the acoustic data 472. The device 102 initiates transmission of the directional audio data 552, the directional audio data 554, or both, as an output stream 550 to the device 104.

The device 104 receives the output stream 550 from the device 102. The audio decoder 506A generates the acoustic data 172 by decoding the directional audio data 552. The audio decoder 506B generates the acoustic data 472 by decoding the directional audio data 554. The audio decoder 506A, in response to determining that the acoustic data 172 is associated with a first channel (e.g., right channel), provides the acoustic data 172 to the speaker 120 associated with the first channel. The audio decoder 506B, in response to determining that the acoustic data 472 is associated with a second channel (e.g., left channel), provides the acoustic data 472 to the speaker 122 associated with the second channel.

The system 500 thus enables most of the processing to be offloaded from the device 104 to the device 102. The system 500 also enables the stream generator 140 and the stream selector 142 to operate with legacy audio output devices, such as the device 104.

Figure 6:
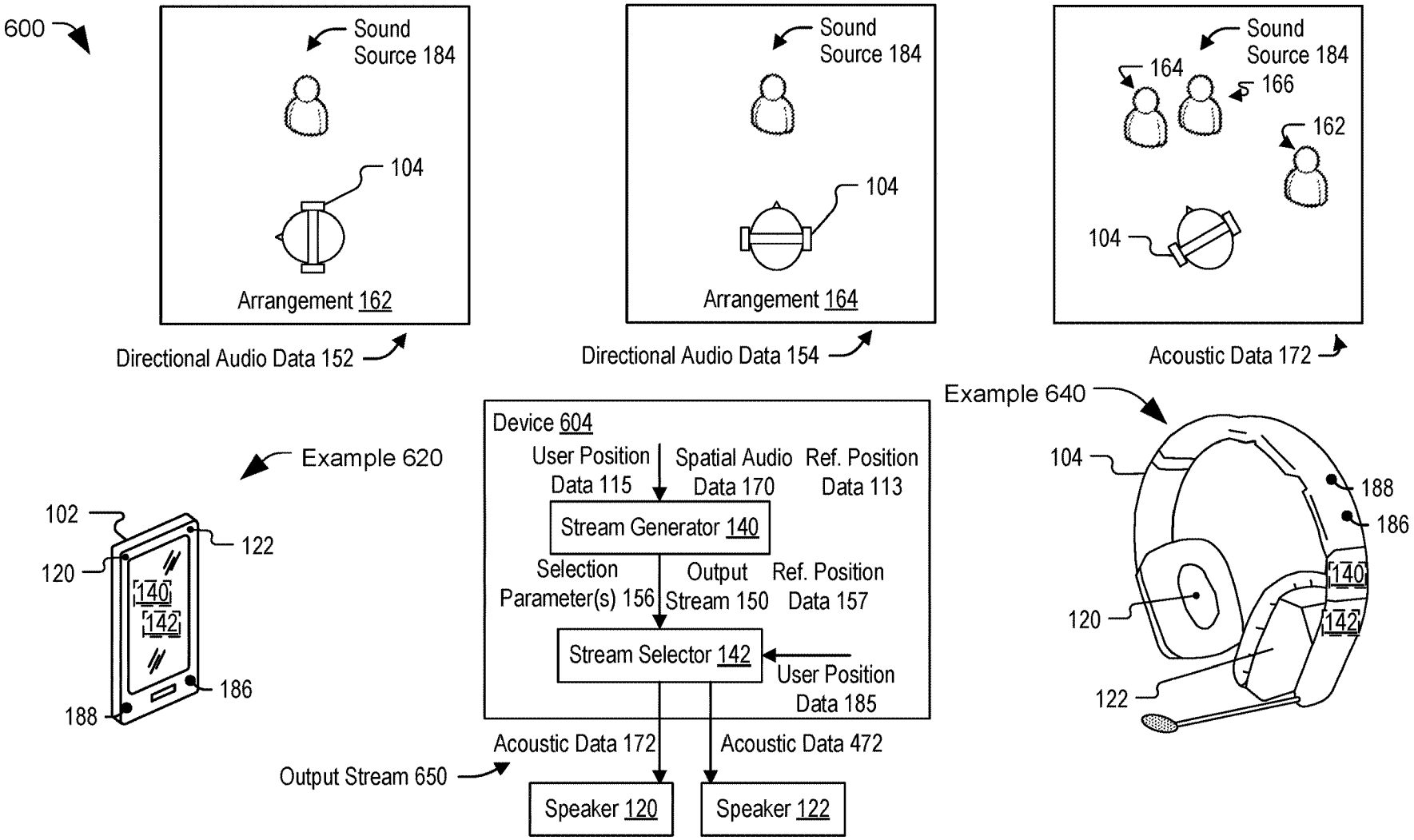
FIG. 6 is a diagram of another illustrative aspect of a system operable to generate directional audio with multiple sound source arrangements, in accordance with some examples of the present disclosure.

Referring to FIG. 6, a system 600 operable to generate directional audio with multiple sound source arrangements is shown. The system 600 includes a device 604 that includes the stream generator 140 and the stream selector 142. The device 604 is coupled to one or more speakers (e.g., the speaker 120, the speaker 122, one or more additional speakers, or a combination thereof). In a particular aspect, the device 604 includes or is coupled to one or more position sensors (e.g., the position sensor 186, the position sensor 188, or both). In an example 620, the device 102 includes the device 604. In an example 640, the device 104 includes the device 604.

The stream generator 140 receives the user position data 115 from the position sensor 186 at a first time. The stream generator 140 generates the output stream 150, the one or more selection parameters 156, or a combination thereof, based on the spatial audio data 170, the reference position data 113, the user position data 115, or a combination thereof, as described with reference to FIG. 2A. The stream generator 140 provides the output stream 150, the one or more selection parameters 156, or a combination thereof, to the stream selector 142.

The stream selector 142 receives the output stream 150, the one or more selection parameters 156, or a combination thereof, from the stream generator 140. The stream selector 142 receives the user position data 185 from the position sensor 186 at a second time that is subsequent to the first time. In a particular aspect, the stream selector 142 receives the reference position data 157 from the stream generator 140. In an alternative aspect, the stream selector 142 determines the reference position data 157 based on second virtual reference position data indicated by the user interactivity data 111, second device position data from the position sensor 188, or both.

The stream selector 142 generates the acoustic data 172, the acoustic data 472, or both, based on the output stream 150, the one or more selection parameters 156, the position data 476 (e.g., the reference position data 157, the user position data 185, or both), or a combination thereof, as described with reference to FIG. 4. In a particular implementation, the stream selector 142 does not include the audio decoder 406A or the audio decoder 406B. In this implementation, the stream selector 142 provides the directional audio data 152 as the acoustic data 452 and the directional audio data 154 as the acoustic data 454 to the acoustic stream generator 408A. The stream selector 142 provides the directional audio data 252 as the acoustic data 456 and the directional audio data 254 as the acoustic data 458 to the acoustic stream generator 408B.

The stream selector 142 provides the acoustic data 172, the acoustic data 472, or both, as an output stream 650 to one or more speakers. For example, the stream selector 142, in response to determining that the acoustic data 172 is associated with a first channel (e.g., right channel), renders acoustic output based on the acoustic data 172 and provides the acoustic output to the speaker 120 associated with the first channel. The stream selector 142, in response to determining that the acoustic data 472 is associated with a second channel (e.g., left channel), renders acoustic output based on the acoustic data 472 and provides the acoustic output to the speaker 122 associated with the second channel.

The system 600 thus enables the stream generator 140 to reduce audio latency by generating the output stream 150 in advance of receiving the position data 476 (the reference position data 157, the user position data 185, or both). In a particular aspect, generating the acoustic data 172 and the acoustic data 472 from the output stream 150 when the position data 476 is available is faster than adjusting the spatial audio data 170 based on the position data 476 to generate acoustic data.

Figure 7:
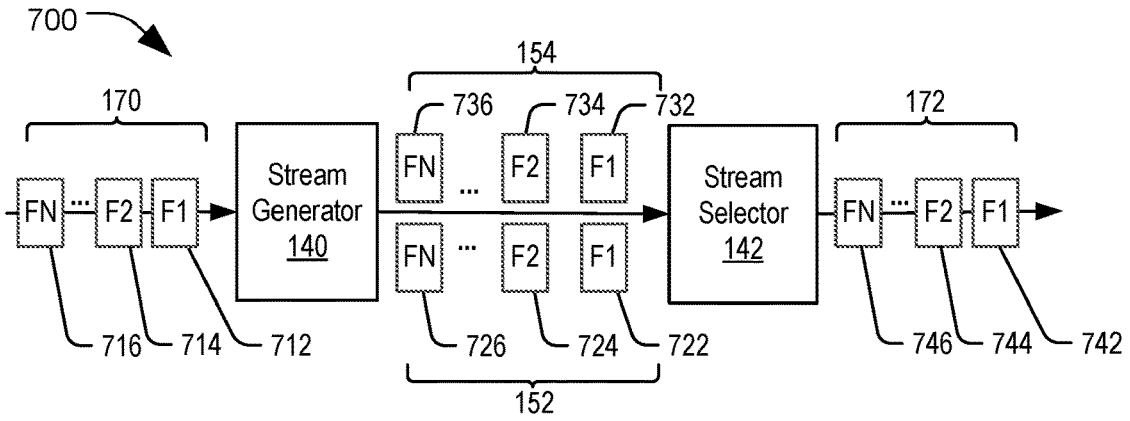
FIG. 7 is a diagram of an illustrative aspect of operation of a stream generator and a stream selector of any of FIG. 1, 5, or 6, in accordance with some examples of the present disclosure.

FIG. 7 is a diagram 700 of an illustrative aspect of operation of the stream generator 140 and the stream selector 142. The stream generator 140 is configured to receive the spatial audio data 170 corresponding to a sequence of audio data samples, such as a sequence of successively captured frames, illustrated as a first frame (F1) 712, a second frame (F2) 714, and one or more additional frames including an Nth frame (FN) 716 (where N is an integer greater than two). The stream generator 140 is configured to output the directional audio data 152 corresponding to a sequence of audio data samples, such as a sequence of frames, illustrated as a first frame (F1) 722, a second frame (F2) 724, and one or more additional sets including an Nth frame (FN) 726. The stream generator 140 is configured to output the directional audio data 154 concurrently with outputting the directional audio data 152. For example, the stream generator 140 is configured to output the directional audio data 154 corresponding to a sequence of audio samples, such as a sequence of frames, illustrated as a first frame (F1) 732, a second frame (F2) 734, and one or more additional sets including an Nth frame (FN) 736.

The stream selector 142 is configured to receive the directional audio data 152 and the directional audio data 154 and to generate the acoustic data 172. For example, the stream selector 142 is configured to output the acoustic data 172 corresponding to a sequence of audio samples, such as a sequence of frames, illustrated as a first frame (F1) 742, a second frame (F2) 744, and one or more additional sets including an Nth frame (FN) 746.

During operation, the stream generator 140 processes the first frame 712 to generate the first frame 722 and the first frame 732. The stream selector 142 generates the first frame 742 based on the first frame 722 and the first frame 732. For example, the stream selector 142 selects one of the first frame 722 or the first frame 732 as the first frame 742. As another example, the stream selector 142 combines the first frame 722 and the first frame 732 to generate the first frame 742. Such processing continues, including the stream generator 140 processing the Nth frame 716 to generate the Nth frame 726 and the Nth frame 736, and the stream selector 142 generates the Nth frame 746 based on the Nth frame 726 and the Nth frame 736. In a particular aspect, the stream generator 140 generates the directional audio data 154 based at least in part on position data associated with prior frames. For example, accuracy of position prediction may improve as audio that spans multiple frames is processed.

Figure 8:
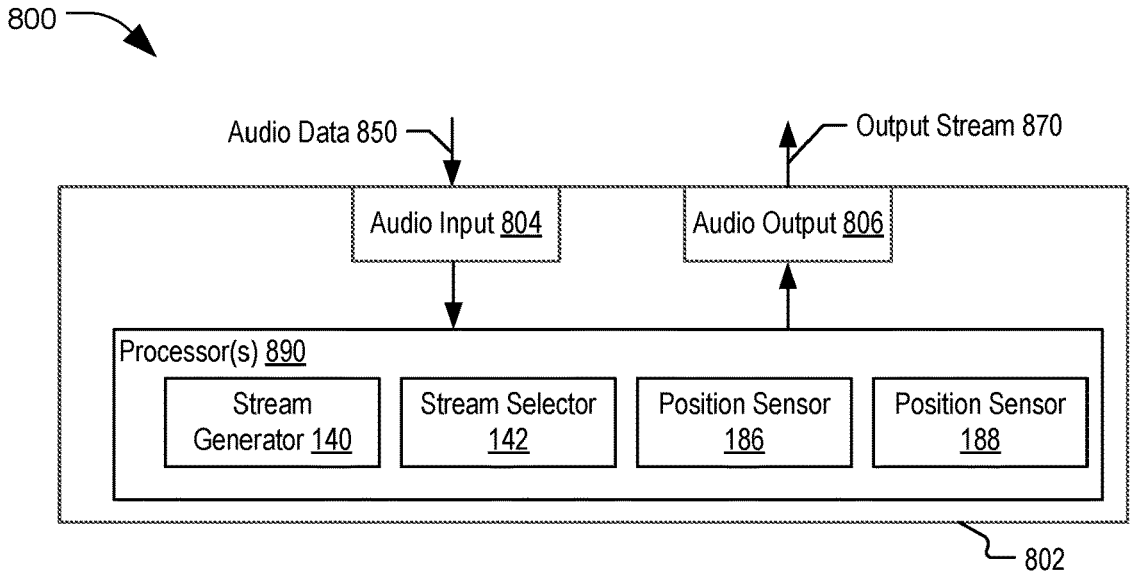
FIG. 8 illustrates an example of an integrated circuit operable to generate directional audio with multiple sound source arrangements, in accordance with some examples of the present disclosure.

FIG. 8 depicts an implementation 800 of an integrated circuit 802 that includes one or more processors 890. The one or more processors 890 include the stream generator 140, the stream selector 142, the position sensor 186, the position sensor 188, or a combination thereof. In a particular aspect, the integrated circuit 802 includes or is included in any of the device 102, the device 104 of FIGS. 1, 5, 6, the device 604 of FIG. 6, or a combination thereof.

The integrated circuit 802 includes an audio input 804, such as one or more bus interfaces, to enable audio data 850 to be received for processing. The integrated circuit 802 also includes an audio output 806, such as a bus interface, to enable sending of an output stream 870. In a particular aspect, the audio data 850 includes the user position data 115, the spatial audio data 170, the reference position data 113, the user interactivity data 111, the device position data 109, or a combination thereof, and the output stream 870 includes the output stream 150, the one or more selection parameters 156, the reference position data 157, or a combination thereof.

In a particular aspect, the audio data 850 includes the output stream 150, the one or more selection parameters 156, the reference position data 157, the user position data 185, or a combination thereof, and the output stream 870 includes the acoustic data 172, the acoustic data 472, the output stream 450, or a combination thereof. In a particular aspect, the audio data 850 includes the user position data 115, the spatial audio data 170, the reference position data 113, the user interactivity data 111, the device position data 109, the reference position data 157, the user position data 185, or a combination thereof, and the output stream 870 includes the directional audio data 552, the directional audio data 554, the output stream 550, or a combination thereof.

In a particular aspect, the audio data 850 includes the user position data 115, the spatial audio data 170, the reference position data 113, the user interactivity data 111, the device position data 109, the reference position data 157, the user position data 185, or a combination thereof, and the output stream 870 includes the acoustic data 172, the acoustic data 472, the output stream 650, or a combination thereof.

Figure 9:
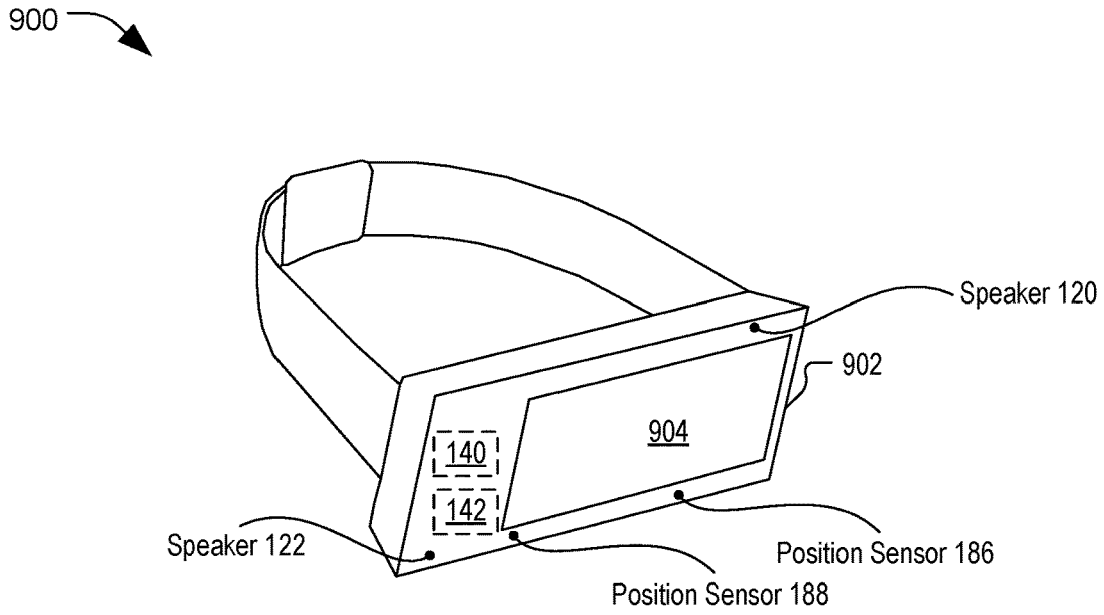
FIG. 9 is a diagram of a wearable electronic device operable to generate directional audio with multiple sound source arrangements, in accordance with some examples of the present disclosure.
Figure 10:
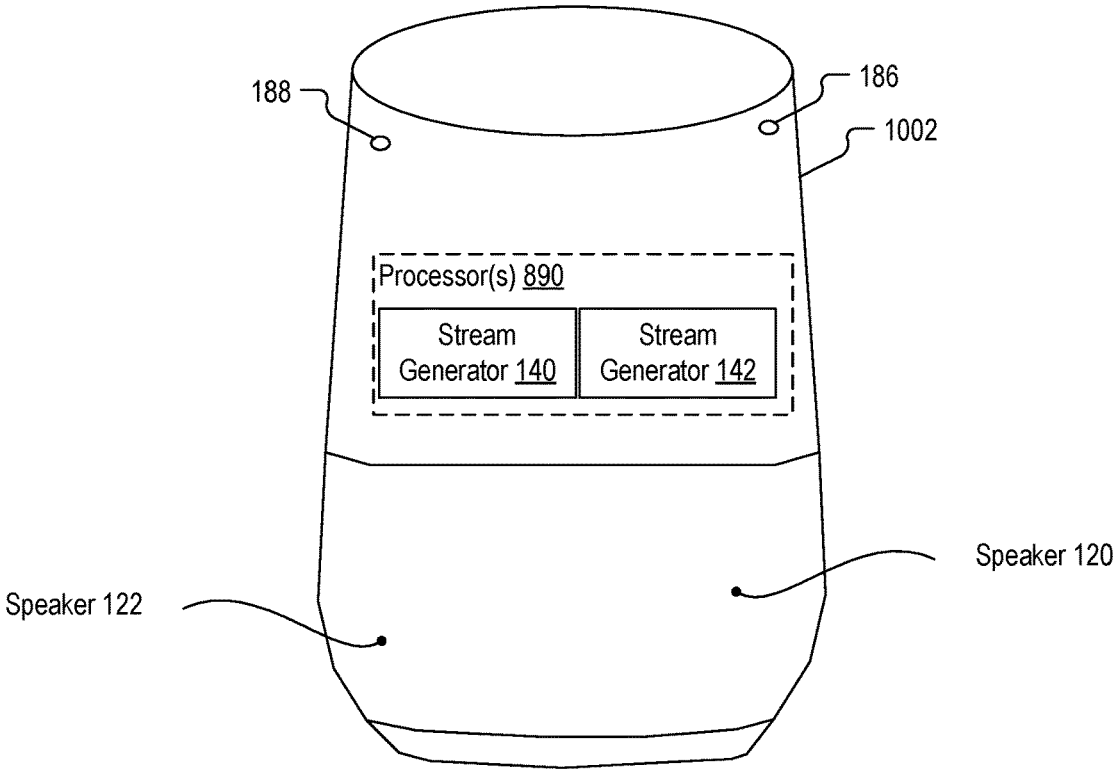
FIG. 10 is a diagram of a voice-controlled speaker system operable to generate directional audio with multiple sound source arrangements, in accordance with some examples of the present disclosure.
Figure 11:
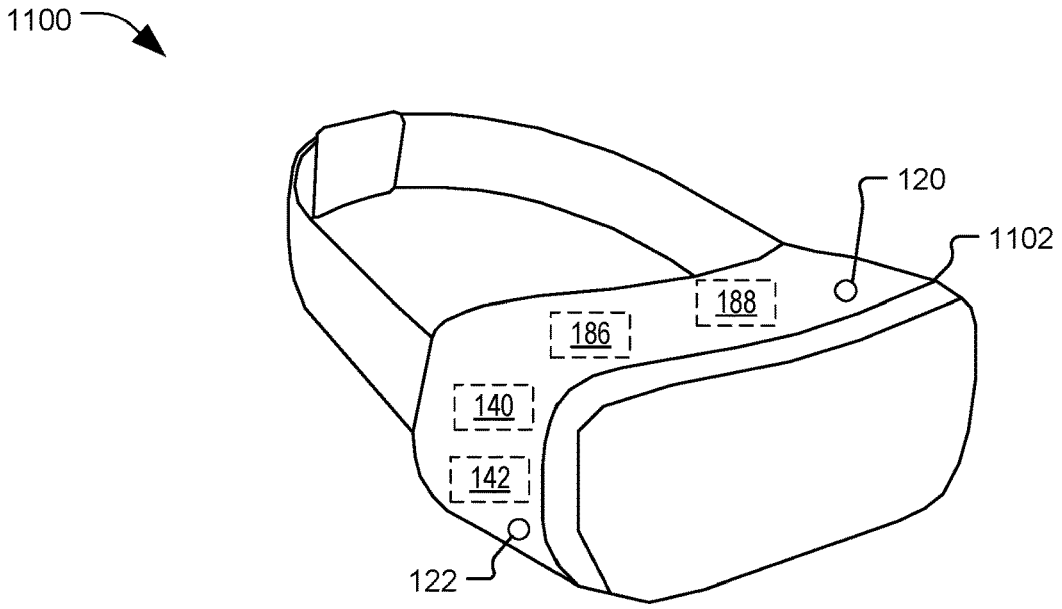
FIG. 11 is a diagram of a headset, such as a virtual reality or augmented reality headset, operable to generate directional audio with multiple sound source arrangements, in accordance with some examples of the present disclosure.
Figure 12:
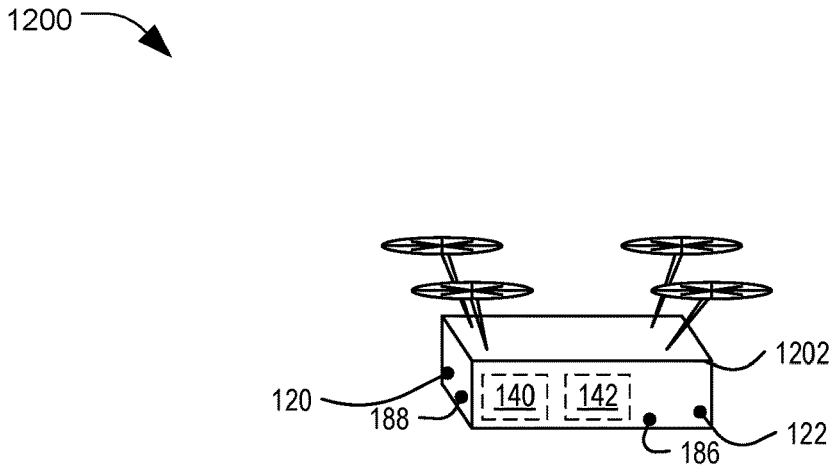
FIG. 12 is a diagram of a first example of a vehicle operable to generate directional audio with multiple sound source arrangements, in accordance with some examples of the present disclosure.
Figure 13:
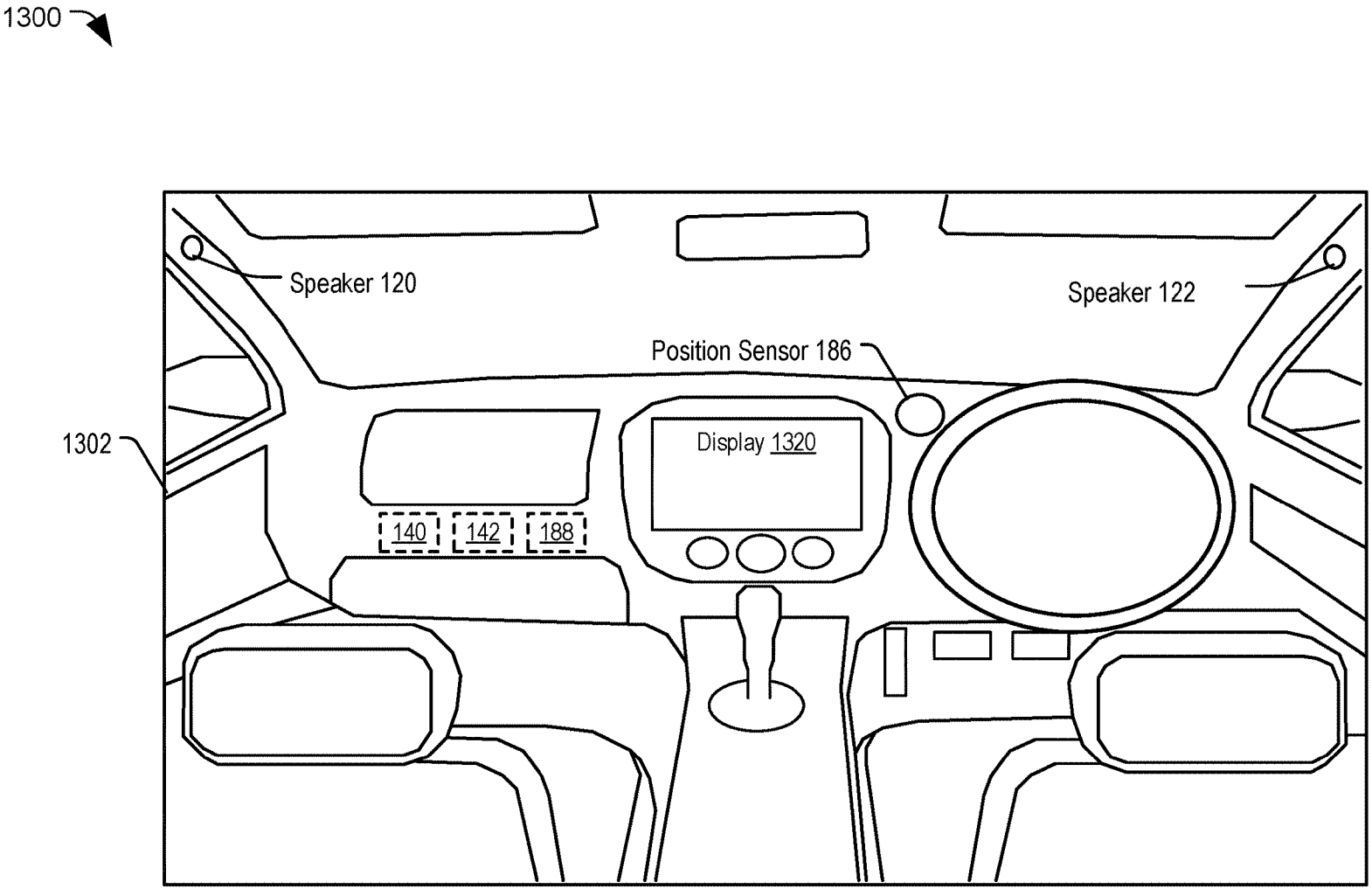
FIG. 13 is a diagram of a second example of a vehicle operable to generate directional audio with multiple sound source arrangements, in accordance with some examples of the present disclosure.

The integrated circuit 802 enables implementation of directional audio generation with multiple sound source arrangements as a component in a system that includes speakers, such as a wearable electronic device as depicted in FIG. 9, a voice-controlled speaker system as depicted in FIG. 10, a virtual reality headset or an augmented reality headset as depicted in FIG. 11, or a vehicle as depicted in FIG. 12 or FIG. 13.

FIG. 9 depicts an implementation 900 of a wearable electronic device 902, illustrated as a "smart watch." In a particular aspect, the wearable electronic device 902 includes the device 102, the device 104 of FIGS. 1, 5, 6, the device 604 of FIG. 6, or a combination thereof.

The stream generator 140, the stream selector 142, or both, are integrated into the wearable electronic device 902. In a particular aspect, the wearable electronic device 902 is coupled to or includes the position sensor 186, the position sensor 188, the speaker 120, the speaker 122, or a combination thereof. In a particular example, the stream generator 140 and the stream selector 142 operate to detect user voice activity in the acoustic data 172, which is then processed to perform one or more operations at the wearable electronic device 902, such as to launch a graphical user interface or otherwise display other information associated with the user's speech at a display screen 904 of the wearable electronic device 902. To illustrate, the wearable electronic device 902 may include a display screen that is configured to display a notification based on user speech detected by the wearable electronic device 902. In a particular example, the wearable electronic device 902 includes a haptic device that provides a haptic notification (e.g., vibrates) in response to detection of user voice activity. For example, the haptic notification can cause a user to look at the wearable electronic device 902 to see a displayed notification indicating detection of a keyword spoken by the user. The wearable electronic device 902 can thus alert a user with a hearing impairment or a user wearing a headset that the user's voice activity is detected.

FIG. 10 is an implementation 1000 of a wireless speaker and voice activated device 1002. In a particular aspect, the wireless speaker and voice activated device 1002 includes the device 102, the device 104 of FIGS. 1, 5, 6, the device 604 of FIG. 6, or a combination thereof.

The wireless speaker and voice activated device 1002 can have wireless network connectivity and is configured to execute an assistant operation. The one or more processors 890 including the stream generator 140, the stream selector 142, or both, are included in the wireless speaker and voice activated device 1002. In a particular aspect, the wireless speaker and voice activated device 1002 includes or is coupled to the position sensor 186, the position sensor 188, the speaker 120, the speaker 122, or a combination thereof. During operation, in response to receiving a verbal command identified as user speech via operation of the stream generator 140, the stream selector 142, or both, the wireless speaker and voice activated device 1002 can execute assistant operations, such as via execution of a voice activation system (e.g., an integrated assistant application). The assistant operations can include adjusting a temperature, playing music, turning on lights, etc. For example, the assistant operations are performed responsive to receiving a command after a keyword or key phrase (e.g., "hello assistant").

FIG. 11 depicts an implementation 1100 of a portable electronic device that corresponds to a virtual reality, augmented reality, or mixed reality headset 1102. In a particular aspect, the headset 1102 includes the device 102, the device 104 of FIGS. 1, 5, 6, the device 604 of FIG. 6, or a combination thereof. The stream generator 140, the stream selector 142, the position sensor 186, the position sensor 188, the speaker 120, the speaker 122, or a combination thereof are integrated into the headset 1102. In a particular aspect, the acoustic data 172 is output by the stream selector 142 via the speaker 120. A visual interface device is positioned in front of the user's eyes to enable display of augmented reality or virtual reality images or scenes to the user while the headset 1102 is worn.

FIG. 12 depicts an implementation 1200 of a vehicle 1202, illustrated as a manned or unmanned aerial device (e.g., a package delivery drone). In a particular aspect, the vehicle 1202 includes the device 102, the device 104 of FIGS. 1, 5, 6, the device 604 of FIG. 6, or a combination thereof.

The stream generator 140, the stream selector 142, the position sensor 186, the position sensor 188, the speaker 120, the speaker 122, or a combination thereof, are integrated into the vehicle 1202. In a particular aspect, the acoustic data 172 is output by the stream selector 142 via the speaker 120, such as for delivery instructions from an authorized user of the vehicle 1202.

FIG. 13 depicts another implementation 1300 of a vehicle 1302, illustrated as a car. In a particular aspect, the vehicle 1202 includes the device 102, the device 104 of FIGS. 1, 5, 6, the device 604 of FIG. 6, or a combination thereof.

The vehicle 1302 includes the stream generator 140, the stream selector 142, the position sensor 186, the position sensor 188, the speaker 120, the speaker 122, or a combination thereof. In some examples, the stream generator 140 of the vehicle 1302 generates the output stream 150 of FIG. 1 and provides the output stream 150 to the device 104 of a passenger of the vehicle 1302. In some examples, the stream selector 142 provides the output stream 650 of FIG. 6 to the speaker 120, the speaker 122, or both. In a particular implementation, a voice activation system initiates one or more operations of the vehicle 1302 based on one or more keywords (e.g., "unlock," "start engine," "play music," "display weather forecast," or another voice command) detected in the output stream 150, such as by providing feedback or information via a display 1320 or one or more speakers (e.g., the speaker 120, the speaker 122, or both).

Figure 14:
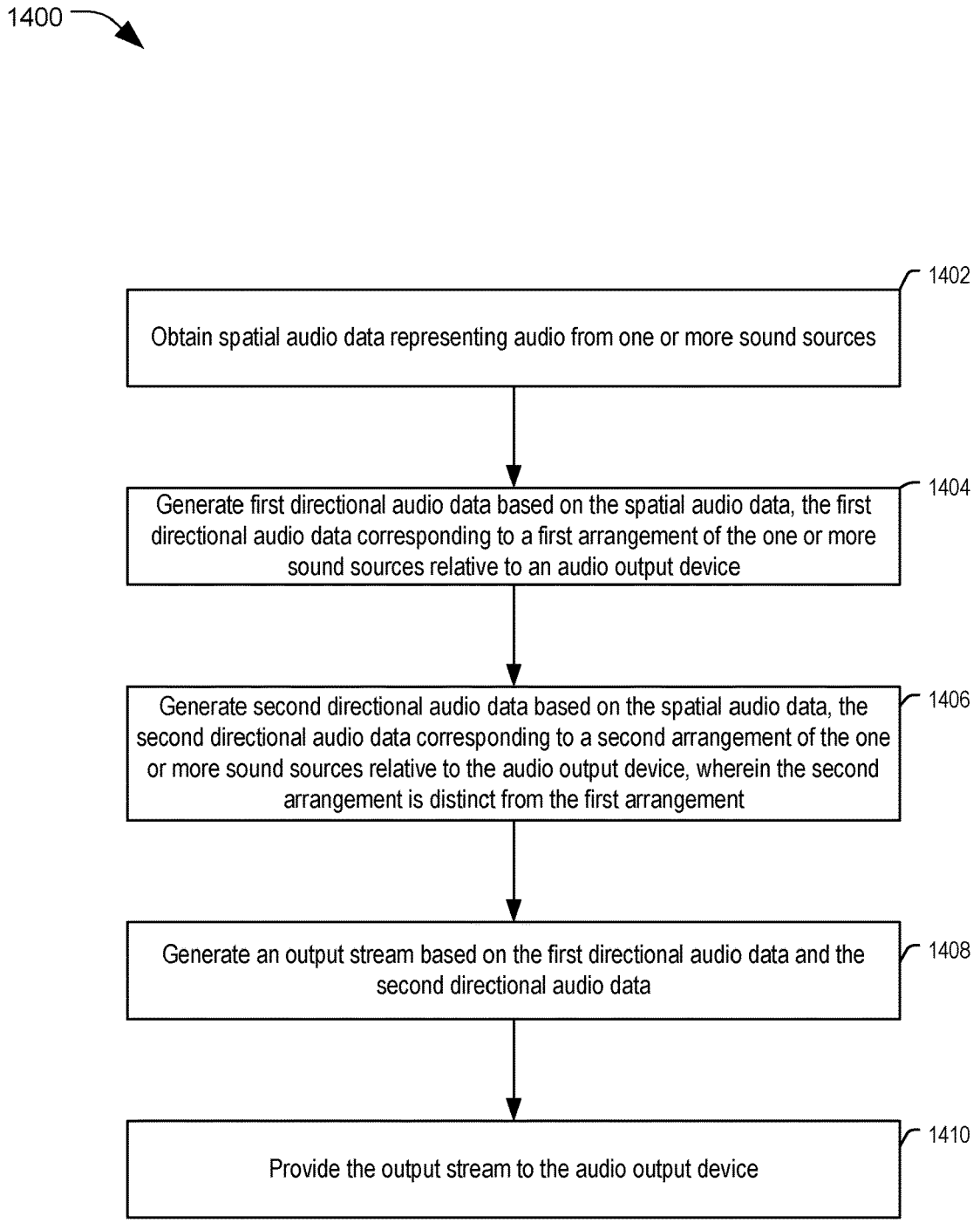
FIG. 14 is a diagram of a particular implementation of a method of generating directional audio with multiple sound source arrangements that may be performed by a device of any of FIGS. 1, 5, 6, 8-13, and 16 in accordance with some examples of the present disclosure.

Referring to FIG. 14, a particular implementation of a method 1400 of generating directional audio with multiple sound source arrangements is shown. In a particular aspect, one or more operations of the method 1400 are performed by at least one of the stream generator 140, the device 102, the device 104, the system 100 of FIG. 1, the device 604 of FIG. 6, or a combination thereof.

The method 1400 includes obtaining spatial audio data representing audio from one or more sound sources, at 1402. For example, the stream generator 140 of FIG. 1 obtains the spatial audio data 170 representing audio from one or more sound sources 184, as described with reference to FIG. 1.

The method 1400 also includes generating first directional audio data based on the spatial audio data, the first directional audio data corresponding to a first arrangement of the one or more sound sources relative to an audio output device, at 1404. For example, the stream generator 140 of FIG. 1 generates the directional audio data 152 based on the spatial audio data 170. The directional audio data 152 corresponds to the arrangement 162 of the one or more sound sources 184 relative to the device 104, the speaker 120, or both, as described with reference to FIG. 1.

The method 1400 further includes generating second directional audio data based on the spatial audio data, the second directional audio data corresponding to a second arrangement of the one or more sound sources relative to the audio output device, wherein the second arrangement is distinct from the first arrangement, at 1406. For example, the stream generator 140 of FIG. 1 generates the directional audio data 154 based on the spatial audio data 170. The directional audio data 154 corresponds to the arrangement 164 of the one or more sound sources 184 relative to the device 104, the speaker 120, or both, as described with reference to FIG. 1.

The method 1400 also includes generating an output stream based on the first directional audio data and the second directional audio data, at 1408. For example, the stream generator 140 of FIG. 1 generates the output stream 150 based on the directional audio data 152 and the directional audio data 154, as described with reference to FIG. 1. In another example, the stream selector 142 generates the output stream 550 based on the directional audio data 152 and the directional audio data 154, as described with reference to FIG. 5. In a particular aspect, the stream selector 142, the device 604, or both, generate the output stream 650 based on the directional audio data 152 and the directional audio data 154, as described with reference to FIG. 6.

The method 1400 further includes providing the output stream to the audio output device, at 1410. For example, the stream generator 140 of FIG. 1 provides the output stream 150 to the device 104, the stream selector 142, or both, as described with reference to FIG. 1. In another example, the stream selector 142 provides the output stream 550 to the device 104, the stream selector 142, or both, as described with reference to FIG. 5. In a particular aspect, the stream selector 142, the device 604, or both, provide the output stream 650 to the speaker 120, the speaker 122, or both, as described with reference to FIG. 6.

The method 1400 can reduce audio latency by generating the directional audio data 152, the directional audio data 154, or both, in advance of receiving the position data 476. In some examples, the method 1400 offloads some processing from an audio output device to a host device.

The method 1400 of FIG. 14 may be implemented by a field-programmable gate array (FPGA) device, an application-specific integrated circuit (ASIC), a processing unit such as a central processing unit (CPU), a digital signal processor (DSP), a graphics processing unit (GPU), a controller, another hardware device, firmware device, or any combination thereof. As an example, the method 1400 of FIG. 14 may be performed by a processor that executes instructions, such as described with reference to FIG. 16.

Figure 15:
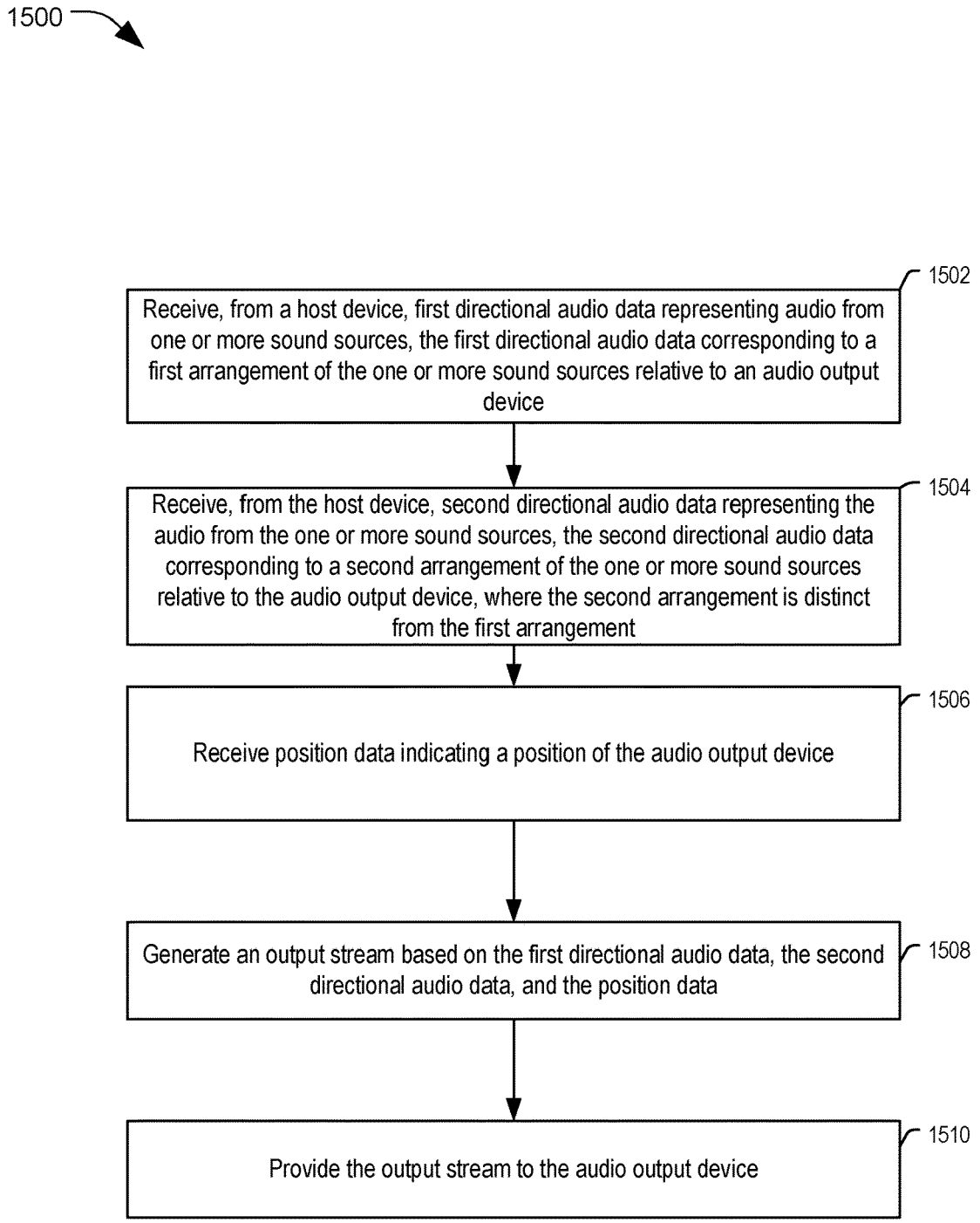
FIG. 15 is a diagram of a particular implementation of a method of generating directional audio with multiple sound source arrangements that may be performed by a device of any of FIG. 1, 5, or 6, in accordance with some examples of the present disclosure.

Referring to FIG. 15, a particular implementation of a method 1500 of generating directional audio with multiple sound source arrangements is shown. In a particular aspect, one or more operations of the method 1500 are performed by at least one of the stream generator 140, the device 102, the device 104, the system 100 of FIG. 1, the device 604 of FIG. 6, or a combination thereof.

The method 1500 includes receiving, from a host device, first directional audio data representing audio from one or more sound sources, the first directional audio data corresponding to a first arrangement of the one or more sound sources relative to an audio output device, at 1502. For example, the device 104, the stream selector 142 of FIG. 1, or both, receive the directional audio data 152 representing audio from the one or more sound sources 184. The directional audio data 152 corresponds to the arrangement 162 of the one or more sound sources 184 relative to a listener (e.g., the device 104, the speaker 120, or both), as described with reference to FIG. 1.

The method 1500 also includes receiving, from the host device, second directional audio data representing the audio from the one or more sound sources, the second directional audio data corresponding to a second arrangement of the one or more sound sources relative to the audio output device, where the second arrangement is distinct from the first arrangement, at 1504. For example, the device 104, the stream selector 142 of FIG. 1, or both, receive the directional audio data 154 representing audio from the one or more sound sources 184. The directional audio data 154 corresponds to the arrangement 164 of the one or more sound sources 184 relative to a listener (e.g., the device 104, the speaker 120, or both), as described with reference to FIG. 1.

The method 1500 further includes receiving position data indicating a position of the audio output device, at 1506. For example, the device 104, the stream selector 142 of FIG. 1, or both, receive the user position data 185 indicating a position of the device 104, the speaker 120, or both, as described with reference to FIG. 1.

The method 1500 also includes generating an output stream based on the first directional audio data, the second directional audio data, and the position data, at 1508. For example, the device 104, the stream selector 142, or both, of FIG. 1 generate the output stream 450 based on the directional audio data 152, the directional audio data 154, and the user position data 185, as described with reference to FIG. 4. In another example, the device 604, the stream selector 142, or both, generate the output stream 650 based on the directional audio data 152, the directional audio data 154, and the user position data 185, as described with reference to FIG. 6.

The method 1500 further includes providing the output stream to the audio output device, at 1510. For example, the device 104, the stream selector 142, or both, of FIG. 1 provide the output stream 450 to the speaker 120, the speaker 122, or both, as described with reference to FIG. 4. In another example, the device 604, the stream selector 142, or both, provide the output stream 650 to the speaker 120, the speaker 122, or both, as described with reference to FIG. 6.

The method 1500 can reduce audio latency by receiving the directional audio data 152, the directional audio data 154, or both, in advance of receiving the position data 476, and generating the acoustic data 172 based on the directional audio data 152, the directional audio data 154, the position data 476, or a combination thereof. In some examples, the method 1500 offloads some processing from an audio output device to a host device.

The method 1500 of FIG. 15 may be implemented by a FPGA device, an ASIC, a processing unit such as a CPU, a DSP, a GPU, a controller, another hardware device, firmware device, or any combination thereof. As an example, the method 1500 of FIG. 15 may be performed by a processor that executes instructions, such as described with reference to FIG. 16.

Figure 16:
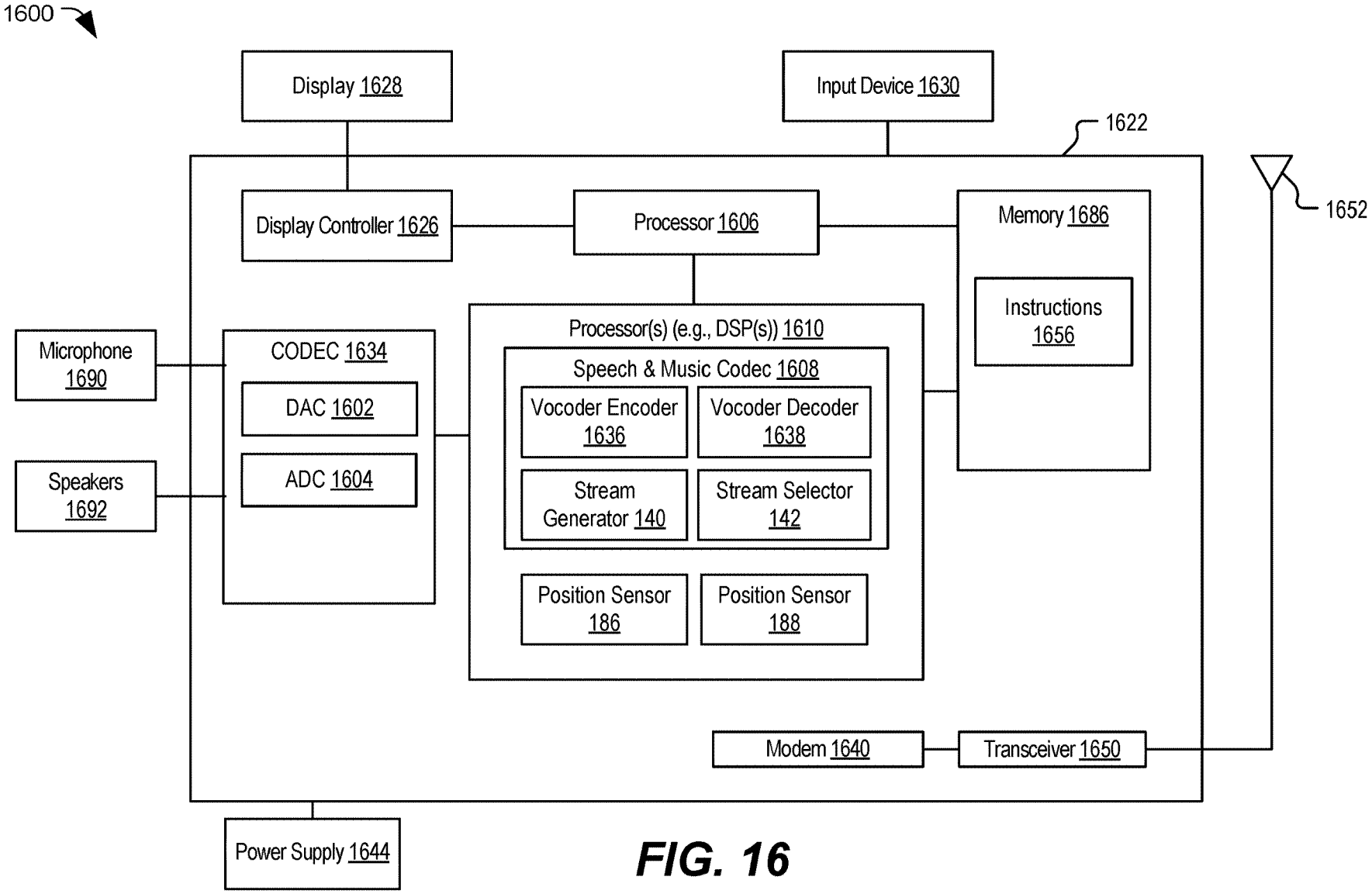
FIG. 16 is a block diagram of a particular illustrative example of a device that is operable to generate directional audio with multiple sound source arrangements, in accordance with some examples of the present disclosure.

Referring to FIG. 16, a block diagram of a particular illustrative implementation of a device is depicted and generally designated 1600. In various implementations, the device 1600 may have more or fewer components than illustrated in FIG. 16. In an illustrative implementation, the device 1600 may correspond to the device 102, the device 104 of FIG. 1, the device 604 of FIG. 6, or a combination thereof. In an illustrative implementation, the device 1600 may perform one or more operations described with reference to FIGS. 1-15.

In a particular implementation, the device 1600 includes a processor 1606 (e.g., a CPU). The device 1600 may include one or more additional processors 1610 (e.g., one or more DSPs, one or more GPUs, or a combination thereof). In a particular aspect, the one or more processors 890 of FIG. 8 correspond to the processor 1606, the processors 1610, or a combination thereof. The processors 1610 may include a speech and music coder-decoder (CODEC) 1608 that includes a voice coder ("vocoder") encoder 1636, a vocoder decoder 1638, the stream generator 140, the stream selector 142, or a combination thereof. In a particular aspect, the processor 1610 includes the position sensor 186, the position sensor 188, or both. In a particular implementation, the position sensor 186, the position sensor 188, or both, are external to the device 1600.

The device 1600 may include a memory 1686 and a CODEC 1634. The memory 1686 may include instructions 1656, that are executable by the one or more additional processors 1610 (or the processor 1606) to implement the functionality described with reference to the stream generator 140, the stream selector 142, or both. The device 1600 may include a modem 1640 coupled, via a transceiver 1650, to an antenna 1652. In a particular aspect, the modem 1640 is configured to receive the encoded audio data 203 of FIG. 2A from the audio data source 202. In a particular aspect, the modem 1640 is configured to exchange data (e.g., the user position data 115, the output stream 150, the one or more selection parameters 156, the user position data 185, the reference position data 157 of FIG. 1, the encoded audio data 203 of FIG. 2A, the output stream 550 of FIG. 5, or a combination thereof) with the device 102, the device 104, the audio data source 202, the device 604, or a combination thereof.

The device 1600 may include a display 1628 coupled to a display controller 1626. One or more speakers 1692, the one or more microphones 1690, or a combination thereof, may be coupled to the CODEC 1634. In a particular aspect, the one or more speakers 1692 include the speaker 120, the speaker 122, or both. The CODEC 1634 may include a digital-to-analog converter (DAC) 1602, an analog-to-digital converter (ADC) 1604, or both. In a particular implementation, the CODEC 1634 may receive analog signals from the one or more microphones 1690, convert the analog signals to digital signals using the analog-to-digital converter 1604, and provide the digital signals to the speech and music codec 1608. The speech and music codec 1608 may process the digital signals, and the digital signals may further be processed by the stream generator 140, the stream selector 142, or both. In a particular implementation, the speech and music codec 1608 may provide digital signals to the CODEC 1634. The CODEC 1634 may convert the digital signals to analog signals using the digital-to-analog converter 1602 and may provide the analog signals to the one or more speakers 1692.

In a particular implementation, the device 1600 may be included in a system-in-package or system-on-chip device 1622. In a particular implementation, the memory 1686, the processor 1606, the processors 1610, the display controller 1626, the CODEC 1634, and the modem 1640 are included in a system-in-package or system-on-chip device 1622. In a particular implementation, an input device 1630 and a power supply 1644 are coupled to the system-on-chip device 1622. Moreover, in a particular implementation, as illustrated in FIG. 16, the display 1628, the input device 1630, the one or more speakers 1692, the one or more microphones 1690, the antenna 1652, and the power supply 1644 are external to the system-on-chip device 1622. In a particular implementation, each of the display 1628, the input device 1630, the one or more speakers 1692, the one or more microphones 1690, the antenna 1652, and the power supply 1644 may be coupled to a component of the system-on-chip device 1622, such as an interface or a controller.

The device 1600 may include a smart speaker, a speaker bar, a mobile communication device, a smart phone, a cellular phone, a laptop computer, a computer, a tablet, a personal digital assistant, a display device, a television, a gaming console, a music player, a radio, a digital video player, a digital video disc (DVD) player, a tuner, a camera, a navigation device, a vehicle, a gaming device, an earphone, a headset, an augmented reality headset, a virtual reality headset, an extended reality headset, an aerial vehicle, a home automation system, a voice-activated device, a speaker, a wireless speaker and voice activated device, a portable electronic device, a car, a computing device, a communication device, an internet-of-things (IoT) device, a host device, an audio output device, a virtual reality (VR) device, a mixed reality (MR) device, an augmented reality (AR) device, an extended reality (XR) device, a base station, a mobile device, or any combination thereof.

In conjunction with the described implementations, an apparatus includes means for obtaining spatial audio data representing audio from one or more sound sources. For example, the means for obtaining spatial audio data can correspond to the stream generator 140, the device 102, the device 104, the system 100 of FIG. 1, the audio decoder 204, the renderer 212, the renderer 214 of FIG. 2A, the device 604 of FIG. 6, the antenna 1652, the transceiver 1650, the modem 1640, the speech and music codec 1608, the processor 1606, the one or more additional processors 1610, one or more other circuits or components configured to obtain spatial audio data, or any combination thereof.

The apparatus also includes means for generating first directional audio data based on the spatial audio data. The first directional audio data corresponds to a first arrangement of the one or more sound sources relative to an audio output device. For example, the means for generating first directional audio data can correspond to the stream generator 140, the device 102, the device 104, the system 100 of FIG. 1, the renderer 212, the renderer 214 of FIG. 2A, the device 604 of FIG. 6, the speech and music codec 1608, the processor 1606, the one or more additional processors 1610, one or more other circuits or components configured to generate directional audio data, or any combination thereof.

The apparatus further includes means for generating second directional audio data based on the spatial audio data. The second directional audio data corresponds to a second arrangement of the one or more sound sources relative to the audio output device. The second arrangement is distinct from the first arrangement. For example, the means for generating second directional audio data can correspond to the stream generator 140, the device 102, the device 104, the system 100 of FIG. 1, the renderer 212, the renderer 214 of FIG. 2A, the device 604 of FIG. 6, the speech and music codec 1608, the processor 1606, the one or more additional processors 1610, one or more other circuits or components configured to generate directional audio data, or any combination thereof.

The apparatus also includes means for generating an output stream based on the first directional audio data and the second directional audio data. For example, the means for generating an output stream can correspond to the stream generator 140, the stream selector 142, the device 102, the device 104, the system 100 of FIG. 1, the renderer 212, the renderer 214 of FIG. 2A, the device 604 of FIG. 6, the speech and music codec 1608, the codec 1634, the processor 1606, the one or more additional processors 1610, the speech and music codec 1608, one or more other circuits or components configured to generate an output stream, or any combination thereof.

The apparatus further includes means for providing the output stream to the audio output device. For example, the means for providing the output stream can correspond to the stream generator 140, the stream selector 142, the device 102, the device 104, the system 100 of FIG. 1, the renderer 212, the renderer 214 of FIG. 2A, the device 604 of FIG. 6, the antenna 1652, the transceiver 1650, the modem 1640, the speech and music codec 1608, the codec 1634, the processor 1606, the one or more additional processors 1610, one or more other circuits or components configured to provide an output stream, or any combination thereof.

Also in conjunction with the described implementations, an apparatus includes means for receiving, from a host device, first directional audio data representing audio from one or more sound sources. The first directional audio data corresponds to a first arrangement of the one or more sound sources relative to an audio output device. For example, the means for receiving can correspond to the stream selector 142, the device 104, the system 100 of FIG. 1, the audio decoder 406A, the audio decoder 406B, the acoustic stream generator 408A, the acoustic stream generator 408B of FIG. 4, the antenna 1652, the transceiver 1650, the modem 1640, the speech and music codec 1608, the codec 1634, the processor 1606, the one or more additional processors 1610, one or more other circuits or components configured to receive directional audio data from a host device, or any combination thereof.

The apparatus also includes means for receiving, from the host device, second directional audio data representing the audio from the one or more sound sources. The second directional audio data corresponds to a second arrangement of the one or more sound sources relative to the audio output device. The second arrangement is distinct from the first arrangement. For example, the means for receiving can correspond to the stream selector 142, the device 104, the system 100 of FIG. 1, the audio decoder 406A, the audio decoder 406B, the acoustic stream generator 408A, the acoustic stream generator 408B of FIG. 4, the antenna 1652, the transceiver 1650, the modem 1640, the speech and music codec 1608, the codec 1634, the processor 1606, the one or more additional processors 1610, one or more other circuits or components configured to receive directional audio data from a host device, or any combination thereof.

The apparatus further includes means for receiving position data indicating a position of the audio output device. For example, the means for receiving can correspond to the stream selector 142, the device 104, the system 100 of FIG. 1, the audio decoder 406A, the combination factor generator 404 of FIG. 4, the antenna 1652, the transceiver 1650, the modem 1640, the speech and music codec 1608, the codec 1634, the processor 1606, the one or more additional processors 1610, one or more other circuits or components configured to receive position data, or any combination thereof.

The apparatus also includes means for generating an output stream based on the first directional audio data, the second directional audio data, and the position data. For example, the means for generating an output stream can correspond to the stream selector 142, the device 104, the system 100 of FIG. 1, the renderer 212, the renderer 214 of FIG. 2A, the speech and music codec 1608, the codec 1634, the processor 1606, the one or more additional processors 1610, the speech and music codec 1608, one or more other circuits or components configured to generate an output stream, or any combination thereof.

The apparatus further includes means for providing the output stream to the audio output device. For example, the means for providing the output stream can correspond to the stream selector 142, the device 104, the system 100 of FIG. 1, the renderer 212, the renderer 214 of FIG. 2A, the antenna 1652, the transceiver 1650, the modem 1640, the speech and music codec 1608, the codec 1634, the processor 1606, the one or more additional processors 1610, one or more other circuits or components configured to provide an output stream, or any combination thereof.

In some implementations, a non-transitory computer-readable medium (e.g., a computer-readable storage device, such as the memory 1686) includes instructions (e.g., the instructions 1656) that, when executed by one or more processors (e.g., the one or more processors 1610, the processor 1606, or the one or more processors 890), cause the one or more processors to obtain spatial audio data (e.g., the spatial audio data 170) representing audio from one or more sound sources (e.g., the one or more sound sources 184). The instructions, when executed by the one or more processors, also cause the one or more processors to generate first directional audio data (e.g., the directional audio data 152) based on the spatial audio data. The first directional audio data corresponds to a first arrangement (e.g., the arrangement 162) of the one or more sound sources relative to an audio output device (e.g., the device 104, the speaker 120, or both). The instructions, when executed by the one or more processors, further cause the one or more processors to generate second directional audio data (e.g., the directional audio data 154) based on the spatial audio data. The second directional audio data corresponds to a second arrangement (e.g., the arrangement 164) of the one or more sound sources relative to the audio output device. The second arrangement is distinct from the first arrangement. The instructions, when executed by the one or more processors, also cause the one or more processors to generate an output stream (e.g., the output stream 150, the output stream 450, the output stream 550, the output stream 650, or a combination thereof) based on the first directional audio data and the second directional audio data. The instructions, when executed by the one or more processors, also cause the one or more processors to provide the output stream to the audio output device.

In some implementations, a non-transitory computer-readable medium (e.g., a computer-readable storage device, such as the memory 1686) includes instructions (e.g., the instructions 1656) that, when executed by one or more processors (e.g., the one or more processors 1610, the processor 1606, or the one or more processors 890), cause the one or more processors to receive, from a host device (e.g., the device 104), first directional audio data (e.g., the directional audio data 152) representing audio from one or more sound sources (e.g., the one or more sound sources 184). The first directional audio data corresponds to a first arrangement (e.g., the arrangement 162) of the one or more sound sources relative to an audio output device (e.g., the device 104, the speaker 120, or both). The instructions, when executed by the one or more processors, also cause the one or more processors to receive, from the host device, second directional audio data (e.g., the directional audio data 154) representing the audio from the one or more sound sources.

The second directional audio data corresponds to a second arrangement (e.g., the arrangement 164) of the one or more sound sources relative to the audio output device. The second arrangement is distinct from the first arrangement. The instructions, when executed by the one or more processors, further cause the one or more processors to receive position data (e.g., the user position data 185) indicating a position of the audio output device. The instructions, when executed by the one or more processors, also cause the one or more processors to generate an output stream (e.g., the output stream 450, the output stream 650, or both) based on the first directional audio data, the second directional audio data, and the position data. The instructions, when executed by the one or more processors, further cause the one or more processors to provide the output stream to the audio output device.

Particular aspects of the disclosure are described below in sets of interrelated clauses:

According to Clause 1, a device includes: a memory configured to store instructions; and a processor configured to execute the instructions to: obtain spatial audio data representing audio from one or more sound sources; generate first directional audio data based on the spatial audio data, the first directional audio data corresponding to a first arrangement of the one or more sound sources relative to an audio output device; generate second directional audio data based on the spatial audio data, the second directional audio data corresponding to a second arrangement of the one or more sound sources relative to the audio output device, wherein the second arrangement is distinct from the first arrangement; and generate an output stream based on the first directional audio data and the second directional audio data.

Clause 2 includes the device of Clause 1, wherein the first arrangement is based on default position data that indicates a default position of the audio output device, a default head position, a default position of a host device, a default relative position of the audio output device and the host device, or a combination thereof.

Clause 3 includes the device of Clause 1 or Clause 2, wherein the first arrangement is based on detected position data that indicates a detected position of the audio output device, a detected movement of the audio output device, a detected head position, a detected head movement, a detected position of a host device, a detected movement of the host device, a detected relative position of the audio output device and the host device, a detected relative movement of the audio output device and the host device, or a combination thereof.

Clause 4 includes the device of any of Clause 1 to Clause 3, wherein the first arrangement is based on user interaction data.

Clause 5 includes the device of any of Clause 1 to Clause 4, wherein the second arrangement is based on predetermined position data that indicates a predetermined position of the audio output device, a predetermined head position, a predetermined position of a host device, a predetermined relative position of the audio output device and the host device, or a combination thereof.

Clause 6 includes the device of any of Clause 1 to Clause 5, wherein the second arrangement is based on predicted position data that indicates a predicted position of the audio output device, a predicted movement of the audio output device, a predicted head position, a predicted head movement, a predicted position of a host device, a predicted movement of the host device, a predicted relative position of the audio output device and the host device, a predicted relative movement of the audio output device and the host device, or a combination thereof.

Clause 7 includes the device of any of Clause 1 to Clause 6, wherein the second arrangement is based on predicted user interaction data.

Clause 8 includes the device of any of Clause 1 to Clause 7, wherein the processor is configured to execute the instructions to: receive first position data indicating a first position of the audio output device; select, based at least in part on the first position data, one of the first directional audio data or the second directional audio data as the output stream; and initiate transmission of the output stream to the audio output device.

Clause 9 includes the device of any of Clause 1 to Clause 8, wherein the processor is configured to execute the instructions to: receive first position data indicating a first position of the audio output device; combine, based at least in part on the first position data, the first directional audio data and the second directional audio data to generate the output stream; and initiate transmission of the output stream to the audio output device.

Clause 10 includes the device of any of Clause 1 to Clause 9, wherein the processor is configured to execute the instructions to: receive first position data indicating a first position of the audio output device; determine a combination factor based at least in part on the first position data; combine, based on the combination factor, the first directional audio data and the second directional audio data to generate the output stream; and initiate transmission of the output stream to the audio output device.

Clause 11 includes the device of any of Clause 1 to Clause 7, wherein the processor is configured to execute the instructions to initiate transmission of the first directional audio data and the second directional audio data as the output stream to the audio output device.

Clause 12 includes the device of any of Clause 1 to Clause 7 or Clause 11, wherein the processor is configured to execute the instructions to: generate the second directional audio data based on one or more parameters; and initiate transmission of the one or more parameters to the audio output device concurrently with transmission of the output stream to the audio output device.

Clause 13 includes the device of Clause 12, wherein the one or more parameters are based on predetermined position data, predicted position data, predicted user interaction data, or a combination thereof.

Clause 14 includes the device of any of Clause 1 to Clause 13, wherein the audio output device includes a speaker, and wherein the processor is configured to execute the instructions to: render acoustic output based on the output stream; and provide the acoustic output to the speaker.

Clause 15 includes the device of any of Clause 1 to Clause 14, wherein the audio output device includes a headset, an extended reality (XR) headset, a gaming device, an earphone, a speaker, or a combination thereof.

Clause 16 includes the device of any of Clause 1 to Clause 15, wherein the processor is integrated in the audio output device.

Clause 17 includes the device of any of Clause 1 to Clause 16, wherein the processor is integrated in a mobile device, a game console, a communication device, a computer, a display device, a vehicle, a camera, or a combination thereof.

Clause 18 includes the device of any of Clause 1 to Clause 17, further including a modem configured to receive audio data from an audio data source, the spatial audio data based on the audio data.

Clause 19 includes the device of any of Clause 1 to Clause 18, wherein the processor is further configured to execute the instructions to generate one or more additional sets of directional audio data based on the spatial audio data, wherein the output stream is based on the one or more additional sets of directional audio data.

According to Clause 20, a device includes: a memory configured to store instructions; and a processor configured to execute the instructions to: receive, from a host device, first directional audio data representing audio from one or more sound sources, the first directional audio data corresponding to a first arrangement of the one or more sound sources relative to an audio output device; receive, from the host device, second directional audio data representing the audio from the one or more sound sources, the second directional audio data corresponding to a second arrangement of the one or more sound sources relative to the audio output device, wherein the second arrangement is distinct from the first arrangement; receive position data indicating a position of the audio output device; generate an output stream based on the first directional audio data, the second directional audio data, and the position data; and provide the output stream to the audio output device.

Clause 21 includes the device of Clause 20, wherein the processor is configured to execute the instructions to select, based at least in part on the position data, one of first audio data corresponding to the first directional audio data or second audio data corresponding to the second directional audio data as the output stream.

Clause 22 includes the device of Clause 20 or Clause 21, wherein the first directional audio data is based on a first position of the audio output device, wherein the second directional audio data is based on a second position of the audio output device, and wherein the processor is configured to execute the instructions to select the one of the first audio data or the second audio data as the output stream based on a comparison of the position with the first position and the second position.

Clause 23 includes the device of any of Clause 20 to Clause 22, wherein the processor is configured to execute the instructions to combine, based at least in part on the position data, first audio data corresponding to the first directional audio data and second audio data corresponding to the second directional audio data to generate the output stream.

Clause 24 includes the device of any of Clause 20 to Clause 23, wherein the processor is configured to execute the instructions to: determine a combination factor based at least in part on the position data; and combine, based on the combination factor, first audio data corresponding to the first directional audio data and second audio data corresponding to the second directional audio data to generate the output stream.

Clause 25 includes the device of Clause 24, wherein the first directional audio data is based on a first position of the audio output device, wherein the second directional audio data is based on a second position of the audio output device, and wherein the combination factor is based on a comparison of the position with the first position and the second position.

Clause 26 includes the device of any of Clause 20 to Clause 25, wherein the processor is configured to execute the instructions to provide, to the host device, first position data indicating a first position of the audio output device detected at a first time, wherein the first directional audio data is based on the first position data.

Clause 27 includes the device of any of Clause 20 to Clause 26, wherein the processor is configured to execute the instructions to receive, from the host device, one or more parameters indicating that the first directional audio data is based on a first position of the audio output device, that the second directional audio data is based on a second position of the audio output device, or both.

Clause 28 includes the device of Clause 27, wherein the first position is based on a default position of the audio output device, a detected position of the audio output device, a detected movement of the audio output device, or a combination thereof.

Clause 29 includes the device of Clause 27 or Clause 28, wherein the second position is based on a predetermined position of the audio output device, a predicted position of the audio output device, a predicted movement of the audio output device, or a combination thereof.

Clause 30 includes the device of any of Clause 20 to Clause 29, wherein the processor is configured to execute the instructions to receive, from the host device, one or more additional sets of directional audio data representing the audio from the one or more sound sources, wherein the output stream is generated based on the one or more additional sets of directional audio data.

According to Clause 31, a method includes: obtaining, at a device, spatial audio data representing audio from one or more sound sources; generating, at the device, first directional audio data based on the spatial audio data, the first directional audio data corresponding to a first arrangement of the one or more sound sources relative to an audio output device; generating, at the device, second directional audio data based on the spatial audio data, the second directional audio data corresponding to a second arrangement of the one or more sound sources relative to the audio output device, wherein the second arrangement is distinct from the first arrangement; generating, at the device, an output stream based on the first directional audio data and the second directional audio data; and providing the output stream from the device to the audio output device.

Clause 32 includes the method of Clause 31, wherein the first arrangement is based on default position data that indicates a default position of the audio output device, a default head position, a default position of a host device, a default relative position of the audio output device and the host device, or a combination thereof.

Clause 33 includes the method of Clause 31 or Clause 32, wherein the first arrangement is based on detected position data that indicates a detected position of the audio output device, a detected movement of the audio output device, a detected head position, a detected head movement, a detected position of a host device, a detected movement of the host device, a detected relative position of the audio output device and the host device, a detected relative movement of the audio output device and the host device, or a combination thereof.

Clause 34 includes the method of any of Clause 31 to Clause 33, wherein the first arrangement is based on user interaction data.

Clause 35 includes the method of any of Clause 31 to Clause 34, wherein the second arrangement is based on predetermined position data that indicates a predetermined position of the audio output device, a predetermined head position, a predetermined position of a host device, a predetermined relative position of the audio output device and the host device, or a combination thereof.

Clause 36 includes the method of any of Clause 31 to Clause 35, wherein the second arrangement is based on predicted position data that indicates a predicted position of the audio output device, a predicted movement of the audio output device, a predicted head position, a predicted head movement, a predicted position of a host device, a predicted movement of the host device, a predicted relative position of the audio output device and the host device, a predicted relative movement of the audio output device and the host device, or a combination thereof.

Clause 37 includes the method of any of Clause 31 to Clause 36, wherein the second arrangement is based on predicted user interaction data.

Clause 38 includes the method of any of Clause 31 to Clause 37, further comprising: receiving first position data indicating a first position of the audio output device; select, based at least in part on the first position data, one of the first directional audio data or the second directional audio data as the output stream; and initiating transmission of the output stream to the audio output device.

Clause 39 includes the method of any of Clause 31 to Clause 38, further comprising: receiving first position data indicating a first position of the audio output device; combine, based at least in part on the first position data, the first directional audio data and the second directional audio data to generate the output stream; and initiate transmission of the output stream to the audio output device.

Clause 40 includes the method of any of Clause 31 to Clause 39, further comprising: receiving first position data indicating a first position of the audio output device; determine a combination factor based at least in part on the first position data; combining, based on the combination factor, the first directional audio data and the second directional audio data to generate the output stream; and initiating transmission of the output stream to the audio output device.

Clause 41 includes the method of any of Clause 31 to Clause 37, further comprising: initiating transmission of the first directional audio data and the second directional audio data as the output stream to the audio output device.

Clause 42 includes the method of any of Clause 31 to Clause 37 or Clause 41, further comprising: generating the second directional audio data based on one or more parameters; and initiating transmission of the one or more parameters to the audio output device concurrently with transmission of the output stream to the audio output device.

Clause 43 includes the method of Clause 42, wherein the one or more parameters are based on predetermined position data, predicted position data, predicted user interaction data, or a combination thereof.

Clause 44 includes the method of any of Clause 31 to Clause 43, wherein the audio output device includes a speaker, and further comprising: rendering acoustic output based on the output stream; and provide the acoustic output to the speaker.

Clause 45 includes the method of any of Clause 31 to Clause 44, wherein the audio output device includes a headset, an extended reality (XR) headset, a gaming device, an earphone, a speaker, or a combination thereof.

Clause 46 includes the method of any of Clause 31 to Clause 45, wherein the audio output device includes a speaker, a second device, or both.

Clause 47 includes the method of any of Clause 31 to Clause 46, wherein the device includes a mobile device, a game console, a communication device, a computer, a display device, a vehicle, a camera, or a combination thereof.

Clause 48 includes the method of any of Clause 31 to Clause 47, further comprising receiving, via a modem, audio data from an audio data source, the spatial audio data based on the audio data.

Clause 49 includes the method of any of Clause 31 to Clause 48, further comprising generating one or more additional sets of directional audio data based on the spatial audio data, wherein the output stream is based on the one or more additional sets of directional audio data.

According to Clause 50, a device includes: a memory configured to store instructions; and a processor configured to execute the instructions to perform the method of any of Clause 31 to 49.

According to Clause 51, a non-transitory computer-readable medium stores instructions that, when executed by a processor, cause the processor to perform the method of any of Clause 31 to Clause 49.

According to Clause 52, an apparatus includes means for carrying out the method of any of Clause 31 to Clause 49.

According to Clause 53, a method includes: receiving, at a device from a host device, first directional audio data representing audio from one or more sound sources, the first directional audio data corresponding to a first arrangement of the one or more sound sources relative to an audio output device; receiving, at the device from the host device, second directional audio data representing the audio from the one or more sound sources, the second directional audio data corresponding to a second arrangement of the one or more sound sources relative to the audio output device, wherein the second arrangement is distinct from the first arrangement; receiving, at the device, position data indicating a position of the audio output device; generating, at the device, an output stream based on the first directional audio data, the second directional audio data, and the position data; and providing the output stream from the device to the audio output device.

Clause 54 includes the method of Clause 53, further comprising selecting, based at least in part on the position data, one of first audio data corresponding to the first directional audio data or second audio data corresponding to the second directional audio data as the output stream.

Clause 55 includes the method of Clause 53 or Clause 54, wherein the first directional audio data is based on a first position of the audio output device, wherein the second directional audio data is based on a second position of the audio output device, and further comprising selecting the one of the first audio data or the second audio data as the output stream based on a comparison of the position with the first position and the second position.

Clause 56 includes the method of any of Clause 53 to Clause 55, further comprising combining, based at least in part on the position data, first audio data corresponding to the first directional audio data and second audio data corresponding to the second directional audio data to generate the output stream.

Clause 57 includes the method of any of Clause 53 to Clause 56, further comprising: determining a combination factor based at least in part on the position data; and combining, based on the combination factor, first audio data corresponding to the first directional audio data and second audio data corresponding to the second directional audio data to generate the output stream.

Clause 58 includes the method of Clause 57, wherein the first directional audio data is based on a first position of the audio output device, wherein the second directional audio data is based on a second position of the audio output device, and wherein the combination factor is based on a comparison of the position with the first position and the second position.

Clause 59 includes the method of any of Clause 53 to Clause 58, further comprising providing, to the host device, first position data indicating a first position of the audio output device detected at a first time, wherein the first directional audio data is based on the first position data.

Clause 60 includes the method of any of Clause 53 to Clause 59, further comprising receiving, from the host device, one or more parameters indicating that the first directional audio data is based on a first position of the audio output device, that the second directional audio data is based on a second position of the audio output device, or both.

Clause 61 includes the method of Clause 60, wherein the first position is based on a default position of the audio output device, a detected position of the audio output device, a detected movement of the audio output device, or a combination thereof.

Clause 62 includes the method of Clause 60 or Clause 61, wherein the second position is based on a predetermined position of the audio output device, a predicted position of the audio output device, a predicted movement of the audio output device, or a combination thereof.

Clause 63 includes the method of any of Clause 53 to Clause 62, further comprising receiving, from the host device, one or more additional sets of directional audio data representing the audio from the one or more sound sources, wherein the output stream is generated based on the one or more additional sets of directional audio data.

According to Clause 64, a device includes: a memory configured to store instructions; and a processor configured to execute the instructions to perform the method of any of Clause 53 to 63.

According to Clause 65, a non-transitory computer-readable medium stores instructions that, when executed by a processor, cause the processor to perform the method of any of Clause 53 to Clause 63.

According to Clause 66, an apparatus includes means for carrying out the method of any of Clause 53 to Clause 63.

According to Clause 67, a non-transitory computer-readable medium includes instructions that, when executed by one or more processors, cause the one or more processors to: obtain spatial audio data representing audio from one or more sound sources; generate first directional audio data based on the spatial audio data, the first directional audio data corresponding to a first arrangement of the one or more sound sources relative to an audio output device; generate second directional audio data based on the spatial audio data, the second directional audio data corresponding to a second arrangement of the one or more sound sources relative to the audio output device, wherein the second arrangement is distinct from the first arrangement; generate an output stream based on the first directional audio data and the second directional audio data; and provide the output stream to the audio output device.

According to Clause 68, a non-transitory computer-readable medium includes instructions that, when executed by one or more processors, cause the one or more processors to receive, from a host device, first directional audio data representing audio from one or more sound sources, the first directional audio data corresponding to a first arrangement of the one or more sound sources relative to an audio output device; receive, from the host device, second directional audio data representing the audio from the one or more sound sources, the second directional audio data corresponding to a second arrangement of the one or more sound sources relative to the audio output device, wherein the second arrangement is distinct from the first arrangement; receive position data indicating a position of the audio output device; generate an output stream based on the first directional audio data, the second directional audio data, and the position data; and provide the output stream to the audio output device.

According to Clause 69, an apparatus includes: means for obtaining spatial audio data representing audio from one or more sound sources; means for generating first directional audio data based on the spatial audio data, the first directional audio data corresponding to a first arrangement of the one or more sound sources relative to an audio output device; means for generating second directional audio data based on the spatial audio data; the second directional audio data corresponding to a second arrangement of the one or more sound sources relative to the audio output device, wherein the second arrangement is distinct from the first arrangement; means for generating an output stream based on the first directional audio data and the second directional audio data; and means for providing the output stream to the audio output device.

According to Clause 70, an apparatus includes means for receiving, from a host device, first directional audio data representing audio from one or more sound sources, the first directional audio data corresponding to a first arrangement of the one or more sound sources relative to an audio output device; means for receiving, from the host device, second directional audio data representing the audio from the one or more sound sources, the second directional audio data corresponding to a second arrangement of the one or more sound sources relative to the audio output device, wherein the second arrangement is distinct from the first arrangement; means for receiving position data indicating a position of the audio output device; means for generating an output stream based on the first directional audio data, the second directional audio data, and the position data; and means for providing the output stream to the audio output device.

Those of skill would further appreciate that the various illustrative logical blocks, configurations, modules, circuits, and algorithm steps described in connection with the implementations disclosed herein may be implemented as electronic hardware, computer software executed by a processor, or combinations of both. Various illustrative components, blocks, configurations, modules, circuits, and steps have been described above generally in terms of their functionality. Whether such functionality is implemented as hardware or processor executable instructions depends upon the particular application and design constraints imposed on the overall system. Skilled artisans may implement the described functionality in varying ways for each particular application, such implementation decisions are not to be interpreted as causing a departure from the scope of the present disclosure.

The steps of a method or algorithm described in connection with the implementations disclosed herein may be embodied directly in hardware, in a software module executed by a processor, or in a combination of the two. A software module may reside in random access memory (RAM), flash memory, read-only memory (ROM), programmable read-only memory (PROM), erasable programmable read-only memory (EPROM), electrically erasable programmable read-only memory (EEPROM), registers, hard disk, a removable disk, a compact disc read-only memory (CD-ROM), or any other form of non-transient storage medium known in the art. An exemplary storage medium is coupled to the processor such that the processor may read information from, and write information to, the storage medium. In the alternative, the storage medium may be integral to the processor. The processor and the storage medium may reside in an application-specific integrated circuit (ASIC). The ASIC may reside in a computing device or a user terminal. In the alternative, the processor and the storage medium may reside as discrete components in a computing device or user terminal.

The previous description of the disclosed aspects is provided to enable a person skilled in the art to make or use the disclosed aspects. Various modifications to these aspects will be readily apparent to those skilled in the art, and the principles defined herein may be applied to other aspects without departing from the scope of the disclosure. Thus, the present disclosure is not intended to be limited to the aspects shown herein but is to be accorded the widest scope possible consistent with the principles and novel features as defined by the following claims.

What is claimed is:

1. A device comprising:

a processor configured to:

obtain spatial audio data representing audio from one or more sound sources;

generate first directional audio data based on the spatial audio data, the first directional audio data corresponding to a first arrangement of the one or more sound sources relative to an audio output device;

generate second directional audio data based on the spatial audio data, the second directional audio data corresponding to a second arrangement of the one or more sound sources relative to the audio output device, wherein the second arrangement is distinct from the first arrangement; and generate an output stream based on the first directional audio data and the second directional audio data.

2. The device of claim 1, wherein the first arrangement is based on default position data that indicates a default position of the audio output device, a default head position, a default position of a host device, a default relative position of the audio output device and the host device, or a combination thereof.

3. The device of claim 1, wherein the first arrangement is based on detected position data that indicates a detected position of the audio output device, a detected movement of the audio output device, a detected head position, a detected head movement, a detected position of a host device, a detected movement of the host device, a detected relative position of the audio output device and the host device, a detected relative movement of the audio output device and the host device, or a combination thereof.

4. The device of claim 1, wherein the first arrangement is based on user interaction data.

5. The device of claim 1, wherein the second arrangement is based on predetermined position data that indicates a predetermined position of the audio output device, a predetermined head position, a predetermined position of a host device, a predetermined relative position of the audio output device and the host device, or a combination thereof.

6. The device of claim 1, wherein the second arrangement is based on predicted position data that indicates a predicted position of the audio output device, a predicted movement of the audio output device, a predicted head position, a predicted head movement, a predicted position of a host device, a predicted movement of the host device, a predicted relative position of the audio output device and the host device, a predicted relative movement of the audio output device and the host device, or a combination thereof.

7. The device of claim 1, wherein the second arrangement is based on predicted user interaction data.

8. The device of claim 1, wherein the processor is configured to:

receive first position data indicating a first position of the audio output device;

select, based at least in part on the first position data, one of the first directional audio data or the second directional audio data as the output stream; and initiate transmission of the output stream to the audio output device.

9. The device of claim 1, wherein the processor is configured to:

receive first position data indicating a first position of the audio output device;

combine, based at least in part on the first position data, the first directional audio data and the second directional audio data to generate the output stream; and initiate transmission of the output stream to the audio output device.

10. The device of claim 1, wherein the processor is configured to:

receive first position data indicating a first position of the audio output device;

determine a combination factor based at least in part on the first position data;

combine, based on the combination factor, the first directional audio data and the second directional audio data to generate the output stream; and initiate transmission of the output stream to the audio output device.

11. The device of claim 1, wherein the processor is configured to initiate transmission of the first directional audio data and the second directional audio data as the output stream to the audio output device.

12. The device of claim 1, wherein the processor is configured to:

generate the second directional audio data based on one or more parameters; and initiate transmission of the one or more parameters to the audio output device concurrently with transmission of the output stream to the audio output device.

13. The device of claim 12, wherein the one or more parameters are based on predetermined position data, predicted position data, predicted user interaction data, or a combination thereof.

14. The device of claim 1, wherein the audio output device includes a speaker, and wherein the processor is configured to:

render acoustic output based on the output stream; and provide the acoustic output to the speaker.

15. The device of claim 1, wherein the audio output device includes a headset, an extended reality (XR) headset, a gaming device, an earphone, a speaker, or a combination thereof.

16. The device of claim 1, wherein the processor is integrated in the audio output device.

17. The device of claim 1, wherein the processor is integrated in a mobile device, a game console, a communication device, a computer, a display device, a vehicle, a camera, or a combination thereof.

18. The device of claim 1, further comprising a modem configured to receive audio data from an audio data source, the spatial audio data based on the audio data.

19. The device of claim 1, wherein the processor is further configured to:

generate a plurality of copies of the first directional audio data, each of the plurality of copies of the first directional audio data corresponding to a different bitrate; and generate a plurality of copies of the second directional audio data, each of the plurality of copies of the first directional audio data corresponding to a different bitrate.

20. A device comprising:

a processor configured to:

receive, from a host device, first directional audio data representing audio from one or more sound sources, the first directional audio data corresponding to a first arrangement of the one or more sound sources relative to an audio output device;

receive, from the host device, second directional audio data representing the audio from the one or more sound sources, the second directional audio data corresponding to a second arrangement of the one or more sound sources relative to the audio output device, wherein the second arrangement is distinct from the first arrangement;

receive position data indicating a position of the audio output device;

generate an output stream based on the first directional audio data, the second directional audio data, and the position data; and provide the output stream to the audio output device.

21. The device of claim 20, wherein the processor is configured to select, based at least in part on the position data, one of first audio data corresponding to the first directional audio data or second audio data corresponding to the second directional audio data as the output stream.

22. The device of claim 21, wherein the first directional audio data is based on a first position of the audio output device, wherein the second directional audio data is based on a second position of the audio output device, and wherein the processor is configured to select the one of the first audio data or the second audio data as the output stream based on a comparison of the position with the first position and the second position.

23. The device of claim 20, wherein the processor is configured to combine, based at least in part on the position data, first audio data corresponding to the first directional audio data and second audio data corresponding to the second directional audio data to generate the output stream.

24. The device of claim 20, wherein the processor is configured to:

determine a combination factor based at least in part on the position data; and combine, based on the combination factor, first audio data corresponding to the first directional audio data and second audio data corresponding to the second directional audio data to generate the output stream.

25. The device of claim 24, wherein the first directional audio data is based on a first position of the audio output device, wherein the second directional audio data is based on a second position of the audio output device, and wherein the combination factor is based on a comparison of the position with the first position and the second position.

26. The device of claim 20, wherein the processor is configured to provide, to the host device, first position data indicating a first position of the audio output device detected at a first time, wherein the first directional audio data is based on the first position data.

27. The device of claim 20, wherein the processor is configured to receive, from the host device, one or more parameters indicating that the first directional audio data is based on a first position of the audio output device, that the second directional audio data is based on a second position of the audio output device, or both, wherein the first position is based on a default position of the audio output device, a detected position of the audio output device, a detected movement of the audio output device, or a combination thereof, and wherein the second position is based on a predetermined position of the audio output device, a predicted position of the audio output device, a predicted movement of the audio output device, or a combination thereof.

28. The device of claim 20, wherein the processor is configured to receive, from the host device, one or more additional sets of directional audio data representing the audio from the one or more sound sources, wherein the output stream is generated based on the one or more additional sets of directional audio data.

29. A method comprising:

obtaining, at a device, spatial audio data representing audio from one or more sound sources;

generating, at the device, first directional audio data based on the spatial audio data, the first directional audio data corresponding to a first arrangement of the one or more sound sources relative to an audio output device;

generating, at the device, second directional audio data based on the spatial audio data, the second directional audio data corresponding to a second arrangement of the one or more sound sources relative to the audio output device, wherein the second arrangement is distinct from the first arrangement;

generating, at the device, an output stream based on the first directional audio data and the second directional audio data; and providing the output stream from the device to the audio output device.

30. A method comprising:

receiving, at a device from a host device, first directional audio data representing audio from one or more sound sources, the first directional audio data corresponding to a first arrangement of the one or more sound sources relative to an audio output device;

receiving, at the device from the host device, second directional audio data representing the audio from the one or more sound sources, the second directional audio data corresponding to a second arrangement of the one or more sound sources relative to the audio output device, wherein the second arrangement is distinct from the first arrangement;

receiving, at the device, position data indicating a position of the audio output device;

generating, at the device, an output stream based on the first directional audio data, the second directional audio data, and the position data; and providing the output stream from the device to the audio output device.

* * * * *